US011680330B2

(12) United States Patent
Shaik et al.

(10) Patent No.: US 11,680,330 B2
(45) Date of Patent: Jun. 20, 2023

(54) ELECTROCHEMICAL-DEPOSITION APPARATUSES AND ASSOCIATED METHODS OF ELECTROPLATING A TARGET ELECTRODE

(71) Applicant: FABRIC8LABS, INC., San Diego, CA (US)

(72) Inventors: Kareemullah Shaik, San Diego, CA (US); Andrew Edmonds, Oceanside, CA (US); Ryan Nicholl, San Diego, CA (US); David Pain, Carlsbad, CA (US)

(73) Assignee: FABRIC8LABS, INC., San Diego, CA (US)

( * ) Notice: Subject to any disclaimer, the term of this patent is extended or adjusted under 35 U.S.C. 154(b) by 0 days.

(21) Appl. No.: 17/738,729

(22) Filed: May 6, 2022

(65) Prior Publication Data

US 2023/0029051 A1 Jan. 26, 2023

Related U.S. Application Data

(60) Provisional application No. 63/303,934, filed on Jan. 27, 2022, provisional application No. 63/260,306, (Continued)

(51) Int. Cl.

| | |
|---|---|
| ***C25D 21/14*** | (2006.01) |
| ***C25D 3/02*** | (2006.01) |
| ***C25D 17/00*** | (2006.01) |

(52) U.S. Cl.

CPC ..... *C25D 3/02* (2013.01); *C25D 17/007* (2013.01); *C25D 21/14* (2013.01)

(58) Field of Classification Search

None

See application file for complete search history.

(56) References Cited

U.S. PATENT DOCUMENTS

| | | | |
|---|---|---|---|
| 4,575,330 | A | 3/1986 | Hull |
| 4,678,282 | A | 7/1987 | Yaniv et al. |

(Continued)

FOREIGN PATENT DOCUMENTS

| | | |
|---|---|---|
| CN | 104178782 | 12/2014 |
| CN | 204097583 | 1/2015 |

(Continued)

OTHER PUBLICATIONS

Frey et al., "Switch-matrix-based High-Density Microelectrode Array in CMOS Technology", IEEE Journal of Solid-State-Circuits, Feb. 2010, pp. 467-482, vol. 45, No. 2.

(Continued)

*Primary Examiner* — Stefanie S Wittenberg

(74) *Attorney, Agent, or Firm* — Kunzler Bean & Adamson

(57) ABSTRACT

A method of electroplating a target electrode comprises establishing a first electric current through an electrolytic solution, comprising a quantity of an electrically charged material, an initial electrode, and a transitional electrode, so that a quantity of the electrically charged material is converted to a quantity of an electrically neutral material, which is electroplated, as a deposit, onto the transitional electrode; and establishing a second electric current through the electrolytic solution, the transitional electrode, and the target electrode so that a quantity of the electrically neutral material from the deposit is converted to a quantity of the electrically charged material, which is dissolved into the electrolytic solution, and a quantity of the electrically charged material in the electrolytic solution is converted to a quantity of the electrically neutral material, which is electroplated onto the surface of the target electrode.

19 Claims, 6 Drawing Sheets

Related U.S. Application Data filed on Aug. 16, 2021, provisional application No. 63/224,716, filed on Jul. 22, 2021.

(56) References Cited

U.S. PATENT DOCUMENTS

| | | | | |
|---|---|---|---|---|
| 5,132,820 | A | 6/1992 | Someya et al. | |
| 5,403,460 | A | 4/1995 | Sala et al. | |
| 5,441,620 | A * | 8/1995 | Nishimura | C25D 17/10 204/240 |
| 5,641,391 | A | 6/1997 | Hunter et al. | |
| 5,998,805 | A | 12/1999 | Shi et al. | |
| 6,036,834 | A | 3/2000 | Clerc | |
| 6,344,124 | B1 * | 2/2002 | Bhatnagar | C25D 5/10 205/97 |
| 7,839,831 | B2 | 11/2010 | Vrcelj et al. | |
| 8,168,540 | B1 | 5/2012 | Reid et al. | |
| 8,681,077 | B2 | 3/2014 | Kimura | |
| 9,777,385 | B2 | 10/2017 | Wirth et al. | |
| 10,465,307 | B2 | 11/2019 | Pain et al. | |
| 10,724,146 | B1 | 7/2020 | Pain et al. | |
| 10,914,000 | B1 | 2/2021 | Pain et al. | |
| 10,947,632 | B1 | 3/2021 | Pain et al. | |
| 11,232,956 | B2 | 1/2022 | Pain et al. | |
| 11,313,035 | B2 | 4/2022 | Pain et al. | |
| 11,313,036 | B2 | 4/2022 | Pain et al. | |
| 2001/0014409 | A1 | 8/2001 | Cohen | |
| 2003/0006133 | A1 | 1/2003 | Metzger | |
| 2004/0129573 | A1 | 7/2004 | Cohen | |
| 2005/0045252 | A1 | 3/2005 | Yamasaki et al. | |
| 2005/0176238 | A1 | 8/2005 | Cohen et al. | |
| 2005/0183959 | A1 | 8/2005 | Wilson et al. | |
| 2005/0202660 | A1 | 9/2005 | Cohen et al. | |
| 2005/0223543 | A1 | 10/2005 | Cohen et al. | |
| 2006/0283539 | A1 | 12/2006 | Slafer | |
| 2007/0068819 | A1 | 3/2007 | Singh et al. | |
| 2007/0089993 | A1 * | 4/2007 | Schwartz | B33Y 30/00 204/224 R |
| 2007/0221504 | A1 | 9/2007 | Yuefeng | |
| 2010/0300886 | A1 | 12/2010 | Lin et al. | |
| 2011/0210005 | A1 | 9/2011 | Van Den Bossche et al. | |
| 2017/0145584 | A1 | 5/2017 | Wirth et al. | |
| 2017/0211199 | A1 * | 7/2017 | Arvin | C25D 17/10 |
| 2019/0160594 | A1 | 5/2019 | Flamm et al. | |
| 2021/0047744 | A1 | 2/2021 | Biton | |

FOREIGN PATENT DOCUMENTS

| | | | |
|---|---|---|---|
| CN | 104593830 | 5/2015 | |
| DE | 3116789 | * 11/1982 | C25D 1/00 |
| WO | 2017087884 | 5/2017 | |
| WO | 2019150362 | 8/2019 | |
| WO | 2021041265 | 3/2021 | |

OTHER PUBLICATIONS

Stewart et al., "Polysilicon TFT Technology for Active Matrix OLED Displays", IEEE Transactions on Electron Devices, May 2001, pp. 845-851, vol. 48, No. 5.

International Search Report and Written Opinion for PCT/US2020/04753I dated Sep. 29, 2020.

Supplementary International Search Report for PCT/US2020/04753I dated Nov. 22, 2021.

U.S. Appl. No. 17/554,677, filed Dec. 17, 2021.

U.S. Appl. No. 17/566,546, filed Dec. 30, 2021.

U.S. Appl. No. 17/535,437, filed Nov. 24, 2021.

U.S. Appl. No. 17/099,602, filed Nov. 16, 2020.

* cited by examiner

ELECTROCHEMICAL-DEPOSITION APPARATUSES AND ASSOCIATED METHODS OF ELECTROPLATING A TARGET ELECTRODE

TECHNICAL FIELD

The subject matter, disclosed herein, relates to electroplating apparatuses and methods.

BACKGROUND

Bubbles in electrolytic solution can be generated during electrochemical deposition of material onto an electrode. In some cases, the presence of bubbles in the electrolytic solution can negatively impact the quality of the resulting deposit.

SUMMARY

Reducing the presence of bubbles in an electrolytic solution in an efficient, reliable, and economical manner has proven to be difficult. Accordingly, apparatuses and methods, intended to address at least the above-identified concerns, would find utility.

The following is a non-exhaustive list of examples of the subject matter, disclosed herein.

Disclosed herein is a first electrochemical-deposition apparatus that comprises an initial electrode, a transitional electrode, and a target electrode. The first electrochemical-deposition apparatus additionally comprises an electric-power supply circuit, electrically couplable with the initial electrode, the transitional electrode, and the target electrode. The first electrochemical-deposition apparatus also comprises a controller, configured to, sequentially (i) direct the electric-power supply circuit to establish a first electric current through an electrolytic solution, the initial electrode, and the transitional electrode when a surface of at least a portion of the initial electrode is in direct physical contact with the electrolytic solution, and a surface of at least a portion of the transitional electrode is in direct physical contact with the electrolytic solution, so that a quantity of an electrically charged material in the electrolytic solution is converted to a quantity of an electrically neutral material, which is electroplated, as a deposit, onto the surface of at least the portion of the transitional electrode, (ii) direct the electric-power supply circuit to terminate the first electric current through the electrolytic solution, the initial electrode, and the transitional electrode, and (iii) direct the electric-power supply circuit to either (1) establish a second electric current through the electrolytic solution, the transitional electrode, and the target electrode when a surface of at least a portion of the deposit is in direct physical contact with the electrolytic solution, and a surface of at least a portion of the target electrode is in direct physical contact with the electrolytic solution, so that a quantity of the electrically neutral material from the deposit is converted to a quantity of the electrically charged material, which is dissolved into the electrolytic solution, and a quantity of the electrically charged material in the electrolytic solution is converted to a quantity of the electrically neutral material, which is electroplated onto the surface of at least the portion of the target electrode, or (2) establish a third electric current through a second electrolytic solution, the transitional electrode, and the target electrode when a surface of at least a portion of the deposit is in direct physical contact with the second electrolytic solution, and a surface of at least a portion of the target electrode is in direct physical contact with the second electrolytic solution, so that a quantity of the electrically neutral material from the deposit is converted to a quantity of the electrically charged material, which is dissolved into the second electrolytic solution, and one of (a) a quantity of the electrically charged material in the second electrolytic solution is converted to a quantity of the electrically neutral material, which is electroplated onto the surface of at least the portion of the target electrode, or (b) a quantity of a second electrically charged material in the second electrolytic solution is converted to a quantity of a second electrically neutral material, which is electroplated onto the surface of at least the portion of the target electrode.

The first electrochemical-deposition apparatus promotes a reduction in bubbles, generated in the electrolytic solution or the second electrolytic solution when the electrically neutral material or the second electrically neutral material is electroplated onto the surface of at least the portion of the target electrode. Converting the electrically neutral material from the deposit to the quantity of electrically charged material in the electrolytic solution or the second electrolytic solution enables an electric current, sufficient to deposit the electrically neutral material or the second electrically neutral material onto the target electrode, to flow through the electrolytic solution or the second electrolytic solution to the target electrode while generating little to no bubbles in the electrolytic solution or the second electrolytic solution. Moreover, converting the quantity of the electrically charged material in the electrolytic solution to the quantity of the electrically neutral material and then electroplating, as the deposit, the quantity of the electrically neutral material onto the surface of at least the portion of the transitional electrode, provides an efficient and reliable way to replenish the quantity of the electrically neutral material deposited on the transitional electrode.

Also disclosed herein is a second electrochemical-deposition apparatus that comprises an initial electrode and a transitional electrode. The second electrochemical-deposition apparatus further comprises an electric-power supply circuit, electrically couplable with the initial electrode and the transitional electrode. The second electrochemical-deposition apparatus additionally comprises a controller, configured to, sequentially (i) direct the electric-power supply circuit to establish a first electric current through an electrolytic solution, the initial electrode, and the transitional electrode when a surface of at least a portion of the initial electrode is in direct physical contact with the electrolytic solution, and a surface of at least a portion of the transitional electrode is in direct physical contact with the electrolytic solution, so that a quantity of an electrically charged material in the electrolytic solution is converted to a quantity of an electrically neutral material, which is electroplated, as a deposit, onto the surface of at least the portion of the transitional electrode, (ii) direct the electric-power supply circuit to terminate the first electric current through the electrolytic solution, the transitional electrode, and the initial electrode, and (iii) direct the electric-power supply circuit to either (1) establish a second electric current through the electrolytic solution, the transitional electrode, and a target electrode when a surface of at least a portion of the deposit is in direct physical contact with the electrolytic solution, and a surface of at least a portion of the target electrode is in direct physical contact with the electrolytic solution, so that a quantity of the electrically neutral material from the deposit is converted to a quantity of the electrically charged material, which is dissolved into the electrolytic solution, and a quantity of the electrically charged material in the electrolytic solution is converted to a quantity of the electrically neutral material, which is electroplated onto the surface of at least the portion of the target electrode, or (2) establish a third electric current through a second electrolytic solution, the transitional electrode, and the target electrode when a surface of at least a portion of the deposit is in direct physical contact with the second electrolytic solution, and a surface of at least a portion of the target electrode is in direct physical contact with the second electrolytic solution, so that a quantity of the electrically neutral material from the deposit is converted to a quantity of the electrically charged material, which is dissolved into the second electrolytic solution, and one of (a) a quantity of the electrically charged material in the second electrolytic solution is converted to a quantity of the electrically neutral material, which is electroplated onto the surface of at least the portion of the target electrode, or (b) a quantity of a second electrically charged material in the second electrolytic solution is converted to a quantity of a second electrically neutral material, which is electroplated onto the surface of at least the portion of the target electrode.

The second electrochemical-deposition apparatus promotes a reduction in bubbles, generated in the electrolytic solution or the second electrolytic solution when the electrically neutral material or the second electrically neutral material is electroplated onto the surface of at least the portion of the target electrode. Converting the electrically neutral material from the deposit to the quantity of electrically charged material in the electrolytic solution or the second electrolytic solution enables an electric current, sufficient to deposit the electrically neutral material or the second electrically neutral material onto the target electrode, to flow through the electrolytic solution or the second electrolytic solution to the target electrode while generating little to no bubbles in the electrolytic solution or the second electrolytic solution. Moreover, converting the quantity of the electrically charged material in the electrolytic solution to the quantity of the electrically neutral material and then electroplating, as the deposit, the quantity of the electrically neutral material onto the surface of at least the portion of the transitional electrode, provides an efficient and reliable way to replenish the quantity of the electrically neutral material deposited on the transitional electrode.

Further disclosed herein is a third electrochemical-deposition apparatus that comprises a printhead, comprising a plurality of individually addressable transitional electrodes. The third electrochemical-deposition apparatus also comprises an electric-power supply circuit, electrically couplable with at least one of the plurality of individually addressable transitional electrodes. The third electrochemical-deposition apparatus further comprises a controller, configured to, sequentially, (i) direct the electric-power supply circuit to establish a first electric current through an electrolytic solution, an initial electrode, and at least one of the plurality of individually addressable transitional electrodes when a surface of at least a portion of the initial electrode is in direct physical contact with the electrolytic solution, and a surface of at least a portion of at least the one of the plurality of individually addressable transitional electrodes is in direct physical contact with the electrolytic solution, so that a quantity of an electrically charged material in the electrolytic solution is converted to a quantity of an electrically neutral material, which is electroplated, as a deposit, onto the surface of at least the portion of at least the one of the plurality of individually addressable transitional electrodes, (ii) direct the electric-power supply circuit to terminate the first electric current through the electrolytic solution, at least the one of the plurality of individually addressable transitional electrodes, and the initial electrode, and (iii) direct the electric-power supply circuit to either (1) establish a second electric current through the electrolytic solution, at least the one of the plurality of individually addressable transitional electrodes, and a target electrode when a surface of at least a portion of the deposit is in direct physical contact with the electrolytic solution, and a surface of at least a portion of the target electrode is in direct physical contact with the electrolytic solution, so that a quantity of the electrically neutral material from the deposit is converted to a quantity of the electrically charged material, which is dissolved into the electrolytic solution, and a quantity of the electrically charged material in the electrolytic solution is converted to a quantity of the electrically neutral material, which is electroplated onto the surface of at least the portion of the target electrode, or (2) establish a third electric current through a second electrolytic solution, at least the one of the plurality of individually addressable transitional electrodes, and the target electrode when a surface of at least a portion of the deposit is in direct physical contact with the second electrolytic solution, and a surface of at least a portion of the target electrode is in direct physical contact with the second electrolytic solution, so that a quantity of the electrically neutral material from the deposit is converted to a quantity of the electrically charged material, which is dissolved into the second electrolytic solution, and one of (a) a quantity of the electrically charged material in the second electrolytic solution is converted to a quantity of the electrically neutral material, which is electroplated onto the surface of at least the portion of the target electrode, or (b) a quantity of a second electrically charged material in the second electrolytic solution is converted to a quantity of a second electrically neutral material, which is electroplated onto the surface of at least the portion of the target electrode.

The third electrochemical-deposition apparatus promotes a reduction in bubbles, generated in the electrolytic solution or the second electrolytic solution when the electrically neutral material or the second electrically neutral material is electroplated onto the surface of at least the portion of the target electrode. Converting the electrically neutral material from the deposit to the quantity of electrically charged material in the electrolytic solution or the second electrolytic solution enables an electric current, sufficient to deposit the electrically neutral material or the second electrically neutral material onto the target electrode, to flow through the electrolytic solution or the second electrolytic solution to the target electrode while generating little to no bubbles in the electrolytic solution or the second electrolytic solution. Moreover, converting the quantity of the electrically charged material in the electrolytic solution to the quantity of the electrically neutral material and then electroplating, as the deposit, the quantity of the electrically neutral material onto the surface of at least the portion of the transitional electrode, provides an efficient and reliable way to replenish the quantity of the electrically neutral material deposited on the transitional electrode.

Additionally disclosed herein is a first method of electroplating a target electrode. The method comprises a step of establishing a first electric current through an electrolytic solution, comprising a quantity of an electrically charged material, an initial electrode, a surface of at least a portion of which is in direct physical contact with the electrolytic solution, and a transitional electrode, a surface of at least a portion of which is in direct physical contact with the electrolytic solution, so that a quantity of the electrically charged material in the electrolytic solution is converted to a quantity of an electrically neutral material, which is electroplated, as a deposit, onto the surface of at least the portion of the transitional electrode. The first method also comprises a step of terminating the first electric current through the electrolytic solution, the initial electrode, and the transitional electrode. The first method further comprises a step of establishing a second electric current through the electrolytic solution, the transitional electrode, and the target electrode, a surface of at least a portion of which is in direct physical contact with the electrolytic solution, so that (i) a quantity of the electrically neutral material from the deposit, formed on the surface of at least the portion of the transitional electrode, is converted to a quantity of the electrically charged material, which is dissolved into the electrolytic solution, and (ii) a quantity of the electrically charged material in the electrolytic solution is converted to a quantity of the electrically neutral material, which is electroplated onto the surface of at least the portion of the target electrode.

The first method of electroplating the target electrode promotes a reduction in bubbles, generated in the electrolytic solution when the electrically neutral material is electroplated onto the surface of at least the portion of the target electrode. Converting the electrically neutral material from the deposit to the quantity of electrically charged material in the electrolytic solution enables an electric current, sufficient to deposit the electrically neutral material onto the target electrode, to flow through the electrolytic solution to the target electrode while generating little to no bubbles in the electrolytic solution. Moreover, converting the quantity of the electrically charged material in the electrolytic solution to the quantity of the electrically neutral material and then electroplating, as the deposit, the quantity of the electrically neutral material onto the surface of at least the portion of the transitional electrode, provides an efficient and reliable way to replenish the quantity of the electrically neutral material deposited on the transitional electrode.

Also disclosed herein is a second method of electroplating a target electrode. The second method comprises a step of establishing a first electric current through an electrolytic solution, comprising a quantity of an electrically charged material, an initial electrode, a surface of at least a portion of which is in direct physical contact with the electrolytic solution, and a transitional electrode, a surface of at least a portion of which is in direct physical contact with the electrolytic solution, so that a quantity of the electrically charged material in the electrolytic solution is converted to a quantity of an electrically neutral material, which is electroplated, as a deposit, onto the surface of at least the portion of the transitional electrode. The second method also comprises a step of terminating the first electric current through the electrolytic solution, the initial electrode, and the transitional electrode. The second method also comprises a step of eliminating the direct physical contact of the transitional electrode with the electrolytic solution and establishing direct physical contact of a surface of at least a portion of the transitional electrode with a second electrolytic solution, comprising at least one of a quantity of the electrically charged material or a quantity of a second electrically charged material. The method further comprises a step of establishing a second electric current through the second electrolytic solution, the transitional electrode, and the target electrode, a surface of at least a portion of which is in direct physical contact with the second electrolytic solution, so that a quantity of the electrically neutral material from the deposit, formed on the surface of at least the portion of the transitional electrode, is converted to a quantity of the electrically charged material, which is dissolved into the second electrolytic solution, and either (i) a quantity of the electrically charged material in the second electrolytic solution is converted to a quantity of the electrically neutral material, which is electroplated onto the surface of at least the portion of the target electrode, or (ii) a quantity of the second electrically charged material in the second electrolytic solution is converted to a quantity of a second electrically neutral material, which is electroplated onto the surface of at least the portion of the target electrode.

The second method promotes a reduction in bubbles, generated in the electrolytic solution when the electrically neutral material or the second electrically neutral material is electroplated onto the surface of at least the portion of the target electrode. Converting the electrically neutral material from the deposit to the quantity of electrically charged material in the second electrolytic solution enables an electric current, sufficient to deposit the electrically neutral material or the second electrically neutral material onto the target electrode, to flow through the second electrolytic solution to the target electrode while generating little to no bubbles in the second electrolytic solution. Moreover, converting the quantity of the electrically charged material in the electrolytic solution to the quantity of the electrically neutral material and then electroplating, as the deposit, the quantity of the electrically neutral material onto the surface of at least the portion of the transitional electrode, provides an efficient and reliable way to replenish the quantity of the electrically neutral material deposited on the transitional electrode. The use of the electrolytic solution, to promote electroplating the electrically neutral material onto the transitional electrode, and the use of the second electrolytic solution, to promote electroplating the electrically neutral material or the second electrically neutral material onto the target electrode helps optimize the two electroplating processes by selecting electrolytic solutions that best facilitate the corresponding electroplating process. Additionally, the use of the electrolytic solution, to promote electroplating the electrically neutral material onto the transitional electrode, and the use of the second electrolytic solution, to promote electroplating the electrically neutral material or the second electrically neutral material onto the target electrode helps eliminate skip-plating of the electrically neutral material onto the target electrode when the electrically neutral material is being electroplated, as the deposit, onto the surface of at least the portion of the transitional electrode.

BRIEF DESCRIPTION OF THE DRAWINGS

Reference will now be made to the accompanying drawings, which are not necessarily drawn to scale, and where like reference characters designate the same or similar parts throughout the several views. In the drawings.

DETAILED DESCRIPTION

In FIG. 1, referred to above, solid lines, if any, connecting various elements and/or components may represent mechanical, electrical, fluidic, optical, electromagnetic, and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the subject matter, disclosed herein. Likewise, elements and/or components, if any, represented with dashed lines, indicate alternative examples of the subject matter, disclosed herein. One or more elements shown in solid and/or dashed lines may be omitted from a particular example without departing from the scope of the subject matter, disclosed herein. Environmental elements, if any, are represented with dotted lines. Virtual (imaginary) elements may also be shown for clarity. Those skilled in the art will appreciate that some of the features illustrated in FIG. 1 can be combined in various ways without the need to include other features described in FIG. 1, other drawing figures, and/or the accompanying disclosure, even though such combination or combinations are not explicitly illustrated herein. Similarly, additional features not limited to the examples presented, can be combined with some or all of the features, shown and described herein.

Figure 3:
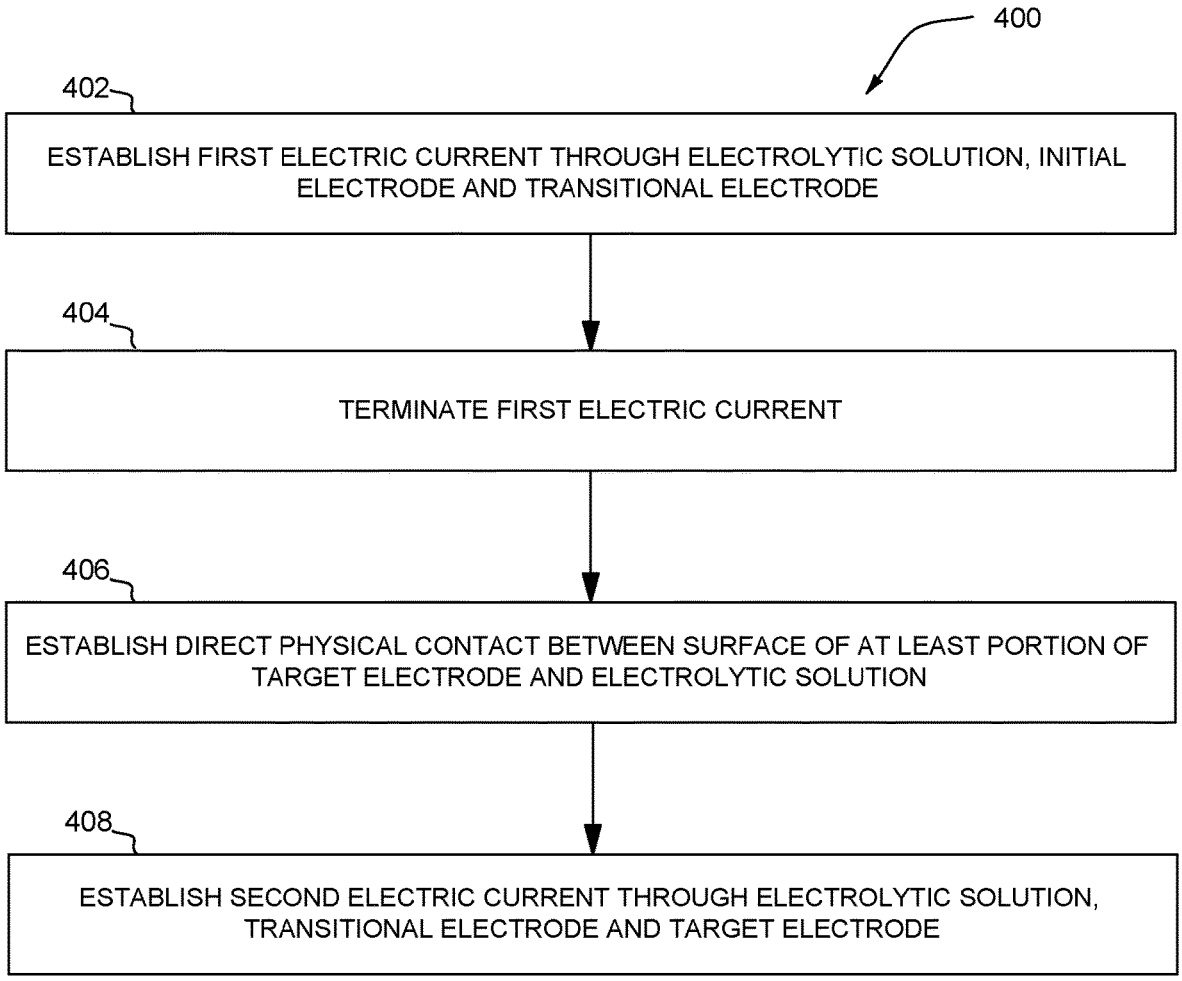
FIG. 3 is a block diagram of a method of electroplating a target electrode, according to one or more examples of the subject matter, disclosed herein.
Figure 4:
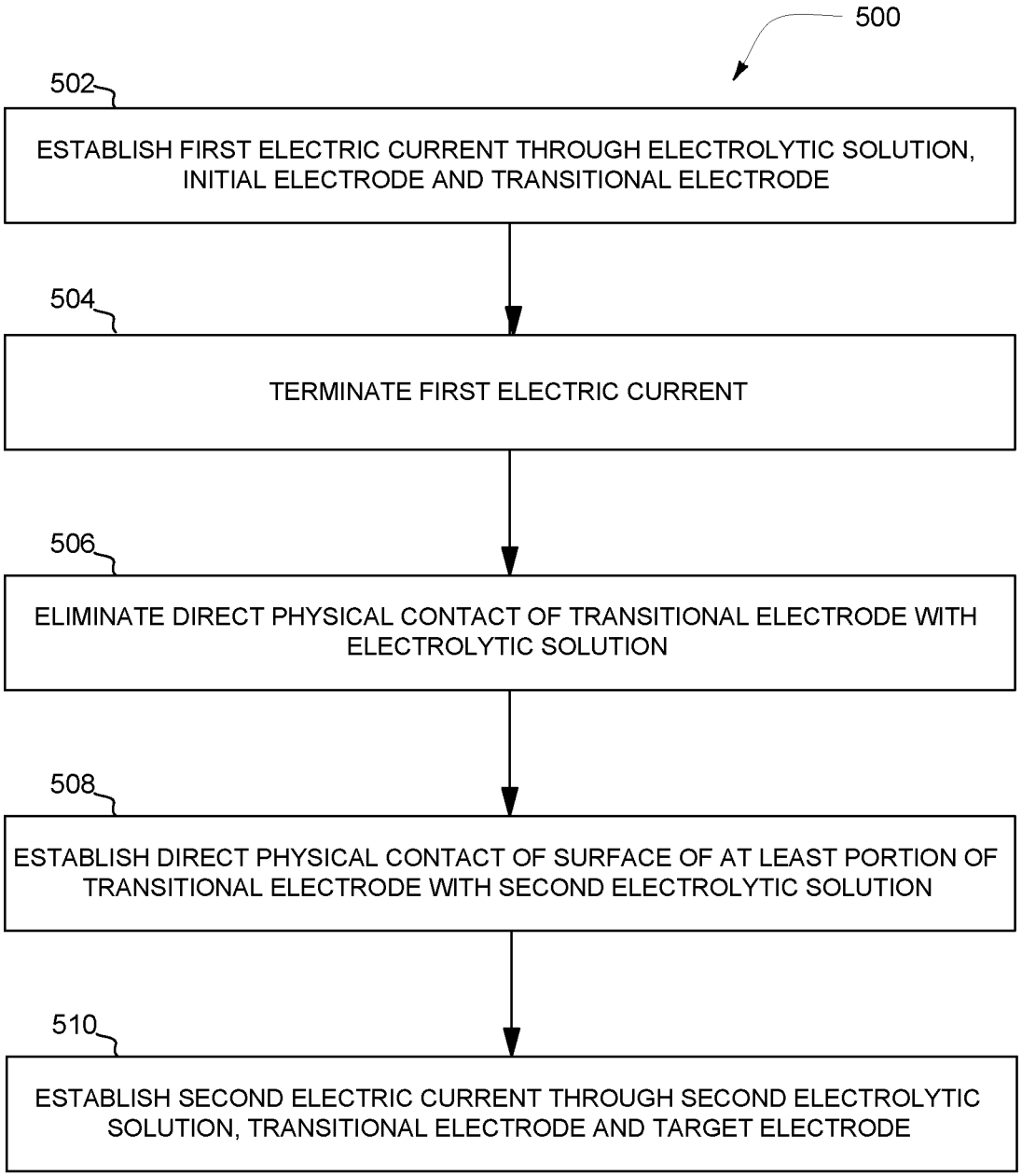
FIG. 4 is a block diagram of a method of electroplating a target electrode, according to one or more examples of the subject matter, disclosed herein.

In FIGS. 3 and 4, referred to above, the blocks may represent operations and/or portions thereof, and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 3 and 4 and the accompanying disclosure, describing the operations of the method(s), set forth herein, should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one or more examples" means that one or more feature, structure, or characteristic described in connection with the example is included in at least one implementation. The phrase "one or more examples" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples of the subject matter, disclosed herein, are provided below.

Referring to FIGS. 1A-2C for illustrative purposes only and not by way of limitation, the following portion of this paragraph delineates example one of the subject-matter, disclosed herein. According to example one, electrochemical-deposition apparatus 100 comprises initial electrode 160, transitional electrode 162, and target electrode 164. Electrochemical-deposition apparatus 100 additionally comprises electric-power supply circuit 141, electrically couplable with initial electrode 160, transitional electrode 162, and target electrode 164. Electrochemical-deposition apparatus 100 also comprises controller 122, configured to, sequentially, (i) direct electric-power supply circuit 141 to establish a first electric current through electrolytic solution 222, initial electrode 160, and transitional electrode 162 when a surface of at least a portion of initial electrode 160 is in direct physical contact with electrolytic solution 222, and a surface of at least a portion of transitional electrode 162 is in direct physical contact with electrolytic solution 222, so that a quantity of an electrically charged material in electrolytic solution 222 is converted to a quantity of an electrically neutral material, which is electroplated, as deposit 166, onto the surface of at least the portion of transitional electrode 162, (ii) direct electric-power supply circuit 141 to terminate the first electric current through electrolytic solution 222, initial electrode 160, and transitional electrode 162, and (iii) direct electric-power supply circuit 141 to either (1) establish a second electric current through electrolytic solution 222, transitional electrode 162, and target electrode 164 when a surface of at least a portion of deposit 166 is in direct physical contact with electrolytic solution 222, and a surface of at least a portion of target electrode 164 is in direct physical contact with electrolytic solution 222, so that a quantity of the electrically neutral material from deposit 166 is converted to a quantity of the electrically charged material, which is dissolved into electrolytic solution 222, and a quantity of the electrically charged material in electrolytic solution 222 is converted to a quantity of the electrically neutral material, which is electroplated onto the surface of at least the portion of target electrode 164, or (2) establish a third electric current through second electrolytic solution 226, transitional electrode 162, and target electrode 164 when a surface of at least a portion of deposit 166 is in direct physical contact with second electrolytic solution 226, and a surface of at least a portion of target electrode 164 is in direct physical contact with second electrolytic solution 226, so that a quantity of the electrically neutral material from deposit 166 is converted to a quantity of the electrically charged material, which is dissolved into second electrolytic solution 226, and one of (a) a quantity of the electrically charged material in second electrolytic solution 226 is converted to a quantity of the electrically neutral material, which is electroplated onto the surface of at least the portion of target electrode 164, or (b) a quantity of a second electrically charged material in second electrolytic solution 226 is converted to a quantity of a second electrically neutral material, which is electroplated onto the surface of at least the portion of target electrode 164.

Electrochemical-deposition apparatus 100 promotes a reduction in bubbles, generated in electrolytic solution 222 or second electrolytic solution 226 when the electrically neutral material or the second electrically neutral material is electroplated onto the surface of at least the portion of target electrode 164. Converting the electrically neutral material from deposit 166 to the quantity of electrically charged material in electrolytic solution 222 or second electrolytic solution 226 enables an electric current, sufficient to deposit the electrically neutral material or the second electrically neutral material onto target electrode 164, to flow through electrolytic solution 222 or second electrolytic solution 226 to target electrode 164 while generating little to no bubbles in electrolytic solution 222 or second electrolytic solution 226. Moreover, converting the quantity of the electrically charged material in electrolytic solution 222 to the quantity of the electrically neutral material and then electroplating, as deposit 166, the quantity of the electrically neutral material onto the surface of at least the portion of transitional electrode 162, provides an efficient and reliable way to replenish the quantity of the electrically neutral material deposited on transitional electrode 162.

As used herein, an electrically charged material is composed of ions, i.e., atoms or molecules, each having a net electric charge due to the loss or gain of one or more electrons. As used herein, an electrically neutral material is composed of atoms or molecules, each having no net electric charge. As used herein, an electrically neutral material from a deposit on a surface of an electrode (anode) is converted to a quantity of an electrically charged material, which is dissolved into an electrolytic solution, when the electrically neutral material is oxidized or loses one or more electrons. As used herein, an electrically charged material in an electrolytic solution is converted to a quantity of an electrically neutral material, which is electroplated, as a deposit, onto a surface of an electrode (cathode), when the electrically charged material in the electrolytic solution is reduced or gains one or more electrons at the cathode.

As used herein, an electrolyte solution is a solution that includes one or more of, but not limited to, plating baths, associated with copper, nickel, tin, silver, gold, lead, etc., and which are typically comprised of water, an acid (such as sulfuric acid), metallic salt, and additives (such as levelers, suppressors, surfactants, accelerators, grain refiners, and pH buffers).

In some examples, target electrode 164 is more flexible than initial electrode 160 and transitional electrode 162, which facilitates removal, from target electrode 164, of an article, deposited onto target electrode 164.

In one or more examples, at least one of initial electrode 160, transitional electrode 162, and target electrode 164 can be made of copper, or metals that are more electrochemically reactive than copper, such as aluminum, lead, nickel, tin, or zinc or can comprise copper, or metals that are more electrochemically reactive than copper, such as aluminum, lead, nickel, tin, or zinc.

Figure 1A:
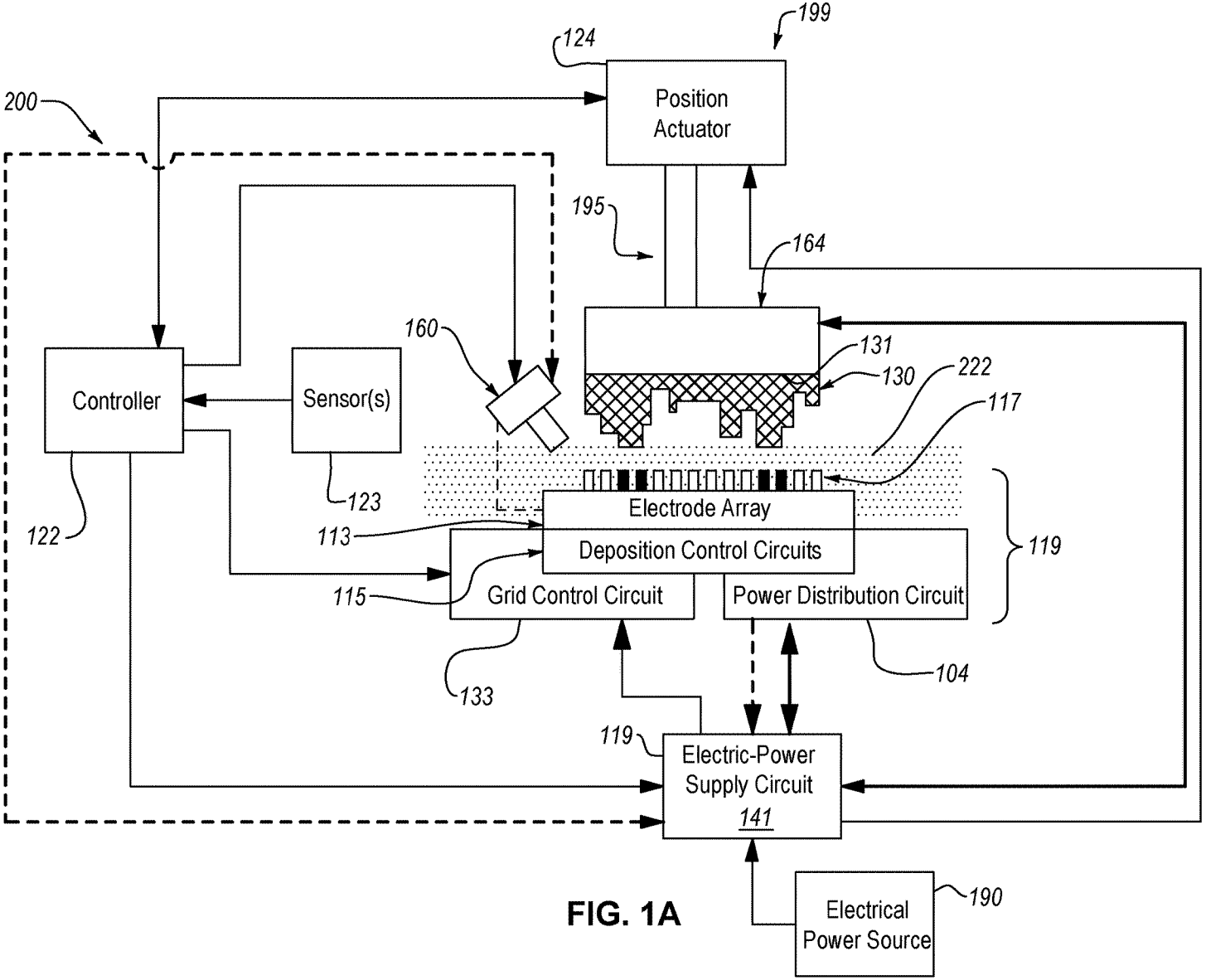
FIG. 1A is a schematic, side elevation view of an electrochemical-deposition apparatus, according to one or more examples of the subject matter, disclosed herein.
Figure 1B:
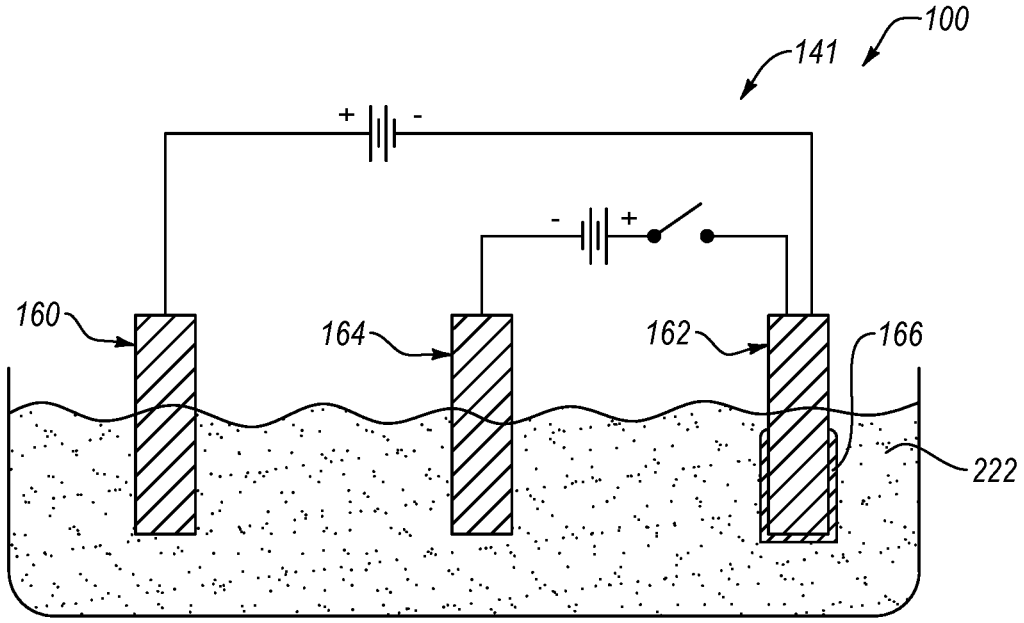
FIG. 1B is a schematic, side elevation, sectional view of an initial electrode, a transitional electrode, a target electrode, and an electric-power supply circuit of the electrochemical-deposition apparatus of FIG. 1A, according to one or more examples of the subject matter, disclosed herein.
Figure 1C:
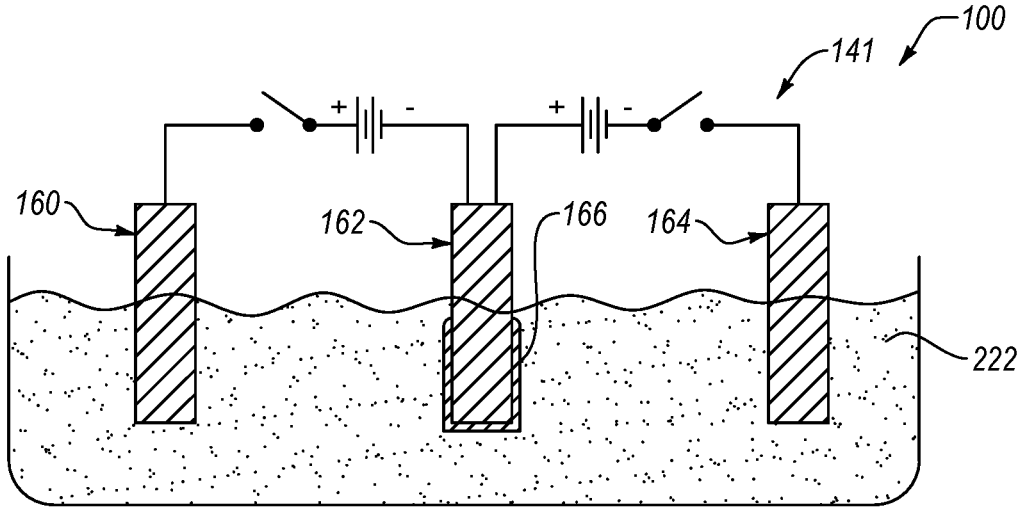
FIG. 1C is a schematic, side elevation, sectional view of an initial electrode, a transitional electrode, a target electrode, and an electric-power supply circuit of the electrochemical-deposition apparatus of FIG. 1A, according to one or more examples of the subject matter, disclosed herein.

Referring to FIGS. 1A-1C for illustrative purposes only and not by way of limitation, the following portion of this paragraph delineates example two of the subject-matter, disclosed herein. According to example two, which encompasses example one, above, initial electrode 160 comprises a quantity of an electrode material. Transitional electrode 162 comprises a quantity of the electrode material.

Initial electrode 160 and transitional electrode 162, comprising a quantity of the electrode material enables initial electrode 160 and transitional electrode 162 to be made of the same electrically conductive material, which promotes simplicity in manufacturing, assembling, and operating electrochemical-deposition apparatus 100.

Referring to FIGS. 1A-1C for illustrative purposes only and not by way of limitation, the following portion of this paragraph delineates example three of the subject-matter, disclosed herein. According to example three, which encompasses example two, above, target electrode 164 comprises a quantity of the electrode material.

Target electrode 164, being made of a quantity of the electrode material, enables initial electrode 160, transitional electrode 162, and target electrode 164 to be made of the same material, which promotes simplicity in manufacturing, assembling, and operating electrochemical-deposition apparatus 100.

Referring to FIGS. 1B-1E for illustrative purposes only and not by way of limitation, the following portion of this paragraph delineates example four of the subject-matter, disclosed herein. According to example four, which encompasses example two or three, above, the electrically neutral material and the electrode material have different chemical compositions.

In one or more examples, the electrically neutral material and the electrode material, having different chemical compositions, enable deposition of a material onto the surface of transitional electrode 162 that is different from one or more materials of transitional electrode 162.

Referring generally to FIGS. 1B-1E for illustrative purposes only and not by way of limitation, the following portion of this paragraph delineates example five of the subject-matter, disclosed herein. According to example five, which encompasses any one of examples two to four, above, the electrically neutral material is more electrochemically reactive than the electrode material.

Those skilled in the art will appreciate that more electrochemically reactive metals are more easily oxidized and react more easily to form compounds than less electrochemically reactive the metals. The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material. In one example, the electrically neutral material is less noble than the electrode material.

In some examples, the electrically neutral material is more electrochemically reactive than the electrode material because the electrically neutral material is more soluble in a given electrolytic solution (e.g., electrolytic solution 222 or second electrolytic solution 226) than the electrode material. In one example, the electrically neutral material is one of copper or a copper alloy and the electrode material is one of platinum-group metals.

Referring to FIGS. 1A-2C for illustrative purposes only and not by way of limitation, the following portion of this paragraph delineates example six of the subject-matter, disclosed herein. According to example six, which encompasses example one, above, initial electrode 160 consists of a quantity of an electrode material. Transitional electrode 162 consists of a quantity of the electrode material.

Initial electrode 160 and transitional electrode 162, consisting of a quantity of the electrode material, enable initial electrode 160 and transitional electrode 162 to be more easily manufactured, assembled, and operated.

Referring to FIGS. 1A-2C for illustrative purposes only and not by way of limitation, the following portion of this paragraph delineates example seven of the subject-matter, disclosed herein. According to example seven, which encompasses example six, above, target electrode 164 consists of a quantity of the electrode material.

Target electrode 164, consisting of a quantity of the electrode material, enables initial electrode 160, transitional electrode 162, and target electrode 164 to be made of the same material, which promotes simplicity in manufacturing, assembling, and operating electrochemical-deposition apparatus 100.

Referring to FIGS. 1B-1E for illustrative purposes only and not by way of limitation, the following portion of this paragraph delineates example eight of the subject-matter, disclosed herein. According to example eight, which encompasses example six or seven, above, the electrically neutral material and the electrode material have different chemical compositions.

In one or more examples, the electrically neutral material and the electrode material, having different chemical compositions, enable one material to be deposited on transitional electrode 162, made of another material.

Referring to FIGS. 1B-1E for illustrative purposes only and not by way of limitation, the following portion of this paragraph delineates example nine of the subject-matter, disclosed herein. According to example nine, which encompasses any one of examples six to eight, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material.

Referring to FIGS. 1B-1E and 2C for illustrative purposes only and not by way of limitation, the following portion of this paragraph delineates example ten of the subject-matter, disclosed herein. According to example ten, which encompasses example one, above, transitional electrode 162 comprises a quantity of an electrode material and, initial electrode 160 comprises a quantity of a second electrode material. The second electrode material is more electrochemically reactive than the electrode material.

The second electrode material of initial electrode 160, being more electrochemically reactive than the electrode material of transitional electrode 162, enables second electrode material of initial electrode 160 to be dissolved in electrolytic solution 222 when the first electric current is directed through electrolytic solution 222, initial electrode 160, and transitional electrode 162.

Referring to 1B-1E and 2C for illustrative purposes only and not by way of limitation, the following portion of this paragraph delineates example eleven of the subject-matter, disclosed herein. According to example eleven, which encompasses example one, above, transitional electrode 162 consists of a quantity of an electrode material and initial electrode 160 consists of a quantity of a second electrode material. The second electrode material is more electrochemically reactive than the electrode material.

The second electrode material of initial electrode 160, being more electrochemically reactive than the electrode material of transitional electrode 162, enables second electrode material of initial electrode 160 to be dissolved in electrolytic solution 222 when the first electric current is directed through electrolytic solution 222, initial electrode 160, and transitional electrode 162.

Referring to FIG. 1B for illustrative purposes only and not by way of limitation, the following portion of this paragraph delineates example twelve of the subject-matter, disclosed herein. According to example twelve, which encompasses any one of examples one to eleven, above, target electrode 164 is interposed between initial electrode 160 and transitional electrode 162.

Target electrode 164, being interposed between initial electrode 160 and transitional electrode 162, enables initial electrode 160, transitional electrode 162, and target electrode 164 to form respective parts of a printhead.

As used herein, the printhead forms part of an electrochemical-deposition apparatus. Referring to FIG. 1A, in one example, printhead 119 forms part of electrochemical-deposition apparatus 200. Printhead 119 includes plurality of electrodes 117, arranged into electrode array 113. In one example, at least one of plurality of electrodes 117 is transitional electrode 162. In some examples, each one of all or some of plurality of electrodes 117 is transitional electrode 162. Printhead 119 further includes plurality of deposition control circuits 115, where at least one of plurality of deposition control circuits 115 corresponds with each one of plurality of electrodes 117 of electrode array 113. Plurality of deposition control circuits 115 are organized into a matrix arrangement, in some examples, thereby supporting a high resolution of plurality of electrodes 117. Plurality of electrodes 117 of electrode array 113 are arranged to form a two-dimensional grid, in some examples. In FIG. 1A, one dimension of the two-dimensional grid is shown with the other dimension of the two-dimensional grid going into and/or coming out of the page. Printhead 119 further includes initial electrode 160 in some examples. However, in other examples, such as shown in FIG. 1A, initial electrode 160 is separate from printhead 119.

Printhead 119 further includes grid control circuit 133 that transmits control signals to plurality of deposition control circuits 115 to control the amount of electrical current flowing to each one of plurality of electrodes 117 of electrode array 113. Printhead 119 additionally includes power distribution circuit 104. The electrical current, supplied to plurality of electrodes 117 via control of grid control circuit 133, is provided by power distribution circuit 104, which routes power from electrical power source 190 of electrochemical-deposition apparatus 200 to plurality of deposition control circuits 115 and then to plurality of electrodes 117. Although not shown, in some examples, printhead 119 also includes features, such as insulation layers, that help protect other features of printhead 119 from electrolytic solution 222 or electrolytic solution 226 (see, e.g., FIG. 1E). In some examples, deposition control circuits 115, grid control circuit 133, power distribution circuit 104, and electrical power source 190 form at least part of electric-power supply circuit 141.

Electrochemical-deposition apparatus 200 is configured to move printhead 119 relative to electrolytic solution 222, or to move electrolytic solution 222 relative to printhead 119, such that plurality of electrodes 117 of electrode array 113 are at least partially submersed in electrolytic solution 222. When at least partially submersed in electrolytic solution 222, and when an electrical current is supplied to at least one of plurality of electrodes 117, an electrical path (or current) is formed through electrolytic solution 222 from the at least one of plurality of electrodes 117 to conductive surface 131 of target electrode 164. In such an example, target electrode 164 functions as a cathode and the at least one of plurality of electrodes 117 functions as an anode of electrochemical-deposition apparatus 200. In response to the electrical path (or current) in electrolytic solution 222, a layer of material 130 is deposited on conductive surface 131 of target electrode 164 at locations corresponding to the locations of the at least one of plurality of electrodes 117. Material 130, which can be one or more layers of metal, formed by supplying electrical current to multiple ones of plurality electrodes 117, forms one or more layers or portions of a part or article, in some examples.

Multiple layers, in a stacked formation, at a given location on target electrode 164 can be formed by incrementally moving printhead 119 away from target electrode 164 and consecutively supplying an electrical current to the one of plurality of electrodes 117 corresponding with that location. Material 130 can have an intricate and detailed shape by modifying or alternating the current, flowing through plurality of electrodes 117. For example, as shown in FIG. 1A, first ones of plurality of electrodes 117 are energized (shaded in FIG. 1A), so that material 130 is being deposited near these "energized" ones of plurality of electrodes 117, when second ones of plurality of electrodes 117 are not energized (unshaded in FIG. 1A), so that material 130 is not being deposited near these "non-energized" ones of plurality of electrodes 117.

In some examples, electrochemical-deposition apparatus 200 further includes controller 122. Printhead 119 is electrically coupled with controller 122 such that controller 122 can transmit electrical signals to grid control circuit 133. In response to receipt of the electrical signals from controller 122, grid control circuit 133 sends corresponding electrical signals to the deposition control circuits 115 to selectively turn one or more of plurality of electrodes 117 "ON" or "OFF" (or to modify the intensity of electrical current flow through plurality of electrodes 117). Controller 122 can be, for example and without limitation, a microcontroller, a microprocessor, a GPU, a FPGA, a SoC, a single-board computer, a laptop, a notebook, a desktop computer, a server, or a network or combination of any of these devices.

According to certain examples, electrochemical-deposition apparatus 200 additionally includes one or more sensors 123. Controller 122 is electrically coupled with sensors 123 to receive feedback signals from sensors 123. The feedback signals include sensed characteristics of electrochemical-deposition apparatus 200 that enable a determination of the progress of the metal deposition process for forming material 130. Sensors 123 can be, for example and without limitation, current sensors, voltage sensors, timers, cameras, rangefinders, scales, force sensors, and/or pressure sensors.

One or more of sensors 123 can be used to measure a distance between printhead 119 and target electrode 164. Measuring the distance between printhead 119 and target electrode 164 enables "zeroing" of printhead 119 relative to target electrode 164 before material 130 is formed, or setting or confirming the relative position between printhead 119 and target electrode 164 before forming each successive metal layer of material 130. The accurate positioning of printhead 119 and target electrode 164 at the initialization of the deposition process can have a significant impact on the success and quality of the completed deposit. In certain examples, any of various types of sensors for determining the distance between printhead 119 and target electrode 164 can be used, including, for example and without limitation, mechanical, electrical, or optical sensors, or combinations thereof. In one or more examples, mechanical sensors, such as a pressure sensor, switch, or load cell can be employed. According to some examples, other types of sensors, such as those that detect, for example, capacitance, impedance, magnetic fields, or that utilize the Hall Effect, can be used to determine the location of printhead 119 relative to target electrode 164.

Referring again to FIG. 1A, in some examples, electrochemical-deposition apparatus 200 further includes mounting system 195 and positioning system 199, which includes position actuator 124. As shown in the illustrated example, target electrode 164 is coupled to position actuator 124, or an additional or alternative position actuator of positioning system 199, via mounting system 195. Mounting system 195 is configured to retain target electrode 164 and to enable target electrode 164 to be positioned in close proximity of plurality of electrodes 117 of printhead 119. Actuation of position actuator 124 moves mounting system 195 and target electrode 164 relative to printhead 119 (and thus relative to plurality of electrodes 117). However, in other examples, printhead 119, rather than target electrode 164, is coupled to position actuator 124 such that actuation of position actuator 124 moves printhead 119 relative to target electrode 164. In yet other examples, both target electrode 164 and printhead 119 are coupled to position actuator 124, such that actuation of position actuator 124 results in one of target electrode 164 or printhead 119 moving relative to the other, or both moving relative to each other.

Position actuator 124 can be a single actuator or multiple actuators that collectively form position actuator 124. In certain examples, position actuator 124 controls movement of target electrode 164 relative to printhead 119, so that target electrode 164 can be moved toward or away from printhead 119, as successive layers of material 130 are built. Alternatively, or additionally, in some examples, position actuator 124 controls movement of printhead 119 relative to target electrode 164, so that printhead 119 can be moved toward or away from target electrode 164, as successive layers of material 130 are built. In one or more examples, position actuator 124 also moves target electrode 164 relative to printhead 119, moves printhead 119 relative to target electrode 164, or moves both the target electrode 164 relative to printhead 119 and printhead 119 relative to target electrode 164 so that printhead 119 and target electrode 164 can be moved relative to each other along respective parallel planes, which can help when forming parts that have a footprint larger than the footprint of electrode array 113.

Although not shown with particularity in FIG. 1A, in one or more examples, electrochemical-deposition apparatus 200 includes a fluid-handling system. The fluid-handling system can include, for example, a tank, a particulate filter, chemically resistant tubing, and a pump. Electrochemical-deposition apparatus 200 can further include analytical equipment that enables continuous characterization of bath pH, temperature, and ion concentration of electrolytic solution 222 using methods such as conductivity, high-performance liquid chromatography, mass spectrometry, cyclic voltammetry stripping, spectrophotometer measurements, or the like. Bath conditions of electrolytic solution 222 can be maintained with a chiller, heater, and/or an automated replenishment system to replace solution lost to evaporation and/or ions of deposited material.

Although electrochemical-deposition apparatus 200, shown in FIG. 1A, has a single printhead with a single deposition anode array, in one or more alternative examples, electrochemical-deposition apparatus 200 comprises multiple printheads, each with one or more deposition anode arrays, or a single printhead with multiple deposition anode arrays. In one or more examples, these multiple deposition anode arrays operate simultaneously in different chambers, filled with the same or different electrolytic solutions, or are arranged so that the deposition anode arrays work together to deposit material on a shared target electrode or series of target electrodes.

Figure 2A:
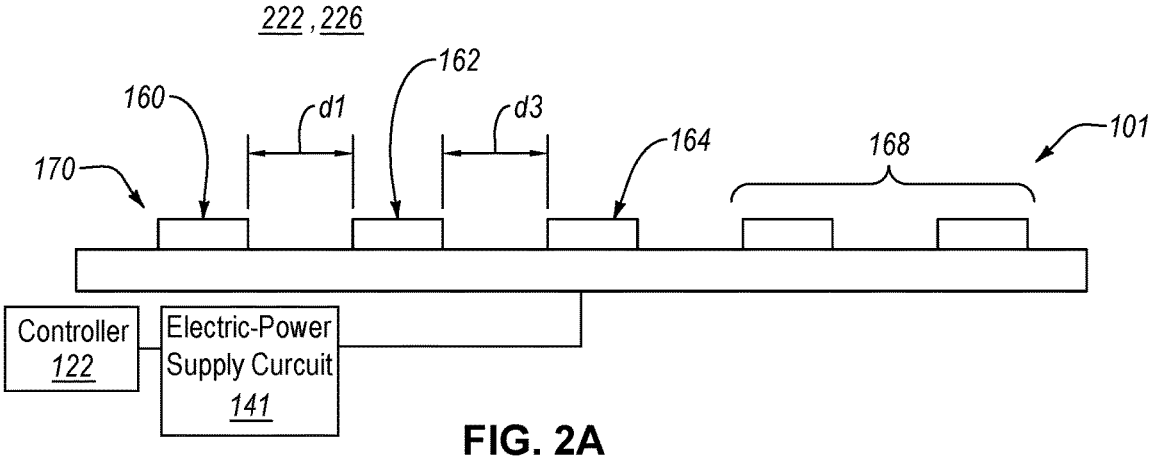
FIG. 2A is a schematic, side elevation view of a printhead of the electrochemical-deposition apparatus of FIG. 1A, according to one or more examples of the subject matter, disclosed herein.

Referring to FIGS. 1C and 2A for illustrative purposes only and not by way of limitation, the following portion of this paragraph delineates example thirteen of the subject-matter, disclosed herein. According to example thirteen, which encompasses any one of examples one to eleven, above, transitional electrode 162 is interposed between initial electrode 160 and target electrode 164.

Transitional electrode 162, being interposed between initial electrode 160 and target electrode 164, enables initial electrode 160, transitional electrode 162, and target electrode 164 to form respective parts of printhead 101. Additionally, transitional electrode 162, being interposed between initial electrode 160 and target electrode 164, helps prevent skip-plating of the electrically neutral material onto target electrode 164 when the electrically neutral material is being electroplated, as deposit 166, onto the surface of at least the portion of transitional electrode 162.

Referring to FIGS. 1A-2C for illustrative purposes only and not by way of limitation, the following portion of this paragraph delineates example fourteen of the subject-matter, disclosed herein. According to example fourteen, which encompasses any one of examples one to thirteen, above, controller 122 is configured to direct electric-power supply circuit 141 to establish the first electric current through electrolytic solution 222, initial electrode 160, and transitional electrode 162 and also to direct electric-power supply circuit 141 to either establish the second electric current through electrolytic solution 222, transitional electrode 162, and target electrode 164, or to establish the third electric current through second electrolytic solution 226, transitional electrode 162, and target electrode 164, such that a rate of electroplating the quantity of the electrically neutral material onto the surface of at least the portion of transitional electrode 162 is higher than a rate of electroplating the quantity of the electrically neutral material onto the surface of at least the portion of target electrode 164.

The rate of electroplating the quantity of the electrically neutral material onto the surface of at least the portion of transitional electrode 162, being higher than the rate of electroplating the quantity of the electrically neutral material onto the surface of at least the portion of target electrode 164, helps to quickly replenish deposit 166 with electrically neutral material in advance of the quantity of the electrically neutral material or the second electrically neutral material being electroplated onto the surface of at least the portion of target electrode 164. In some examples, because the quality of deposit 166 can be lower than the quality of the electrically neutral material or second electrically neutral material electroplated onto the surface of at least the portion of target electrode 164, the rate of electroplating the quantity of the electrically neutral material onto the surface of at least the portion of transitional electrode 162 can be higher than the rate of electroplating the quantity of the electrically neutral material onto the surface of at least the portion of target electrode 164.

Figure 2B:
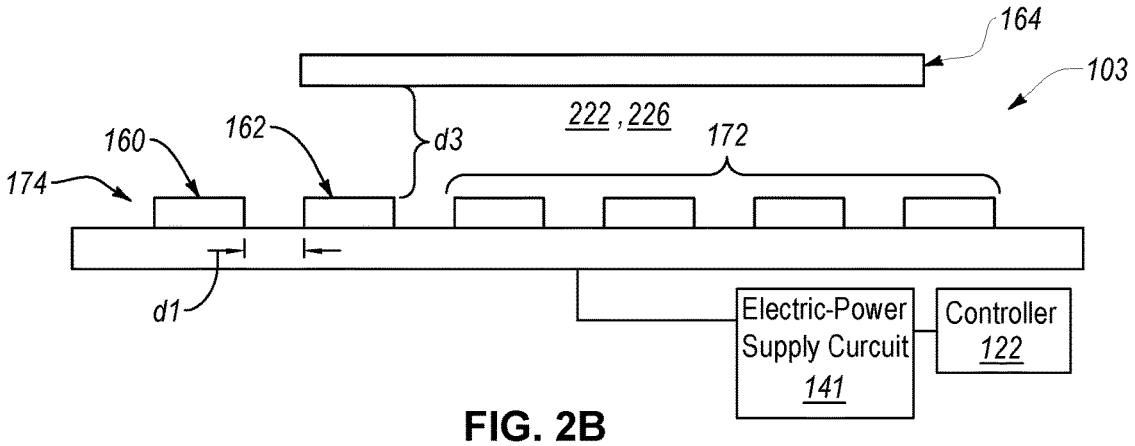
FIG. 2B is a schematic, side elevation view of a printhead and a target electrode of the electrochemical-deposition apparatus of FIG. 1A, according to one or more examples of the subject matter, disclosed herein.
Figure 2C:
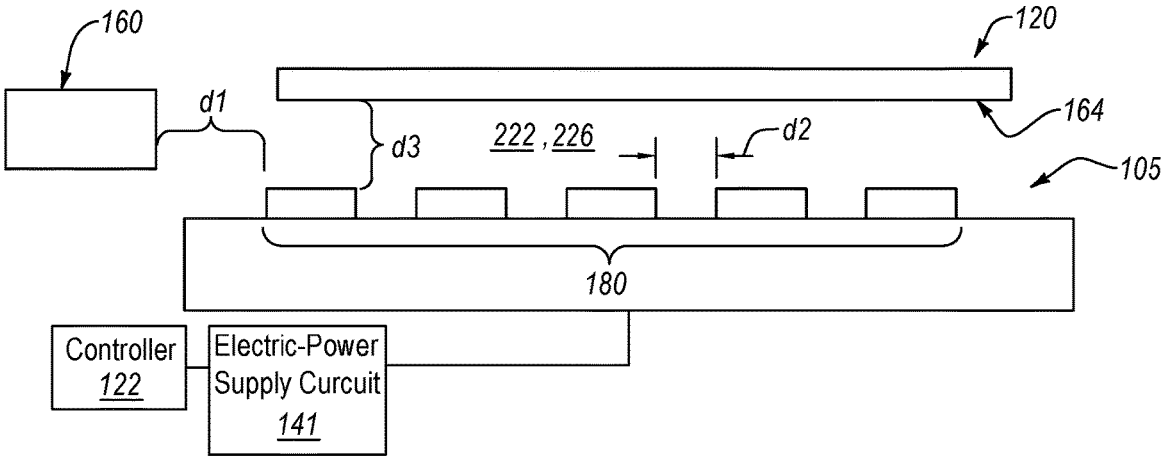
FIG. 2C is a schematic, side elevation view of a printhead, a target electrode, and an initial electrode of the electrochemical-deposition apparatus of FIG. 1A, according to one or more examples of the subject matter, disclosed herein.

Referring to FIGS. 2B and 2C for illustrative purposes only and not by way of limitation, the following portion of this paragraph delineates example fifteen of the subject-matter, disclosed herein. According to example fifteen, which encompasses any one of examples one to fourteen, above, shortest maximum distance d3 between transitional electrode 162 and target electrode 164 is less than 15 centimeters.

Shortest maximum distance d3, being less than 15 centimeters, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2B and 2C for illustrative purposes only and not by way of limitation, the following portion of this paragraph delineates example sixteen of the subject-matter, disclosed herein. According to example sixteen, which encompasses any one of examples one to fourteen, above, shortest maximum distance d3 between transitional electrode 162 and target electrode 164 is less than 5 millimeters.

Shortest maximum distance d3, being less than 5 millimeters, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2B and 2C for illustrative purposes only and not by way of limitation, the following portion of this paragraph delineates example seventeen of the subject-matter, disclosed herein. According to example seventeen, which encompasses any one of examples one to fourteen, above, shortest maximum distance d3 between transitional electrode 162 and target electrode 164 is less than 2 millimeters.

Shortest maximum distance d3, being less than 2 millimeters, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2B and 2C for illustrative purposes only and not by way of limitation, the following portion of this paragraph delineates example eighteen of the subject-matter, disclosed herein. According to example eighteen, which encompasses any one of examples one to fourteen, above, shortest maximum distance d3 between transitional electrode 162 and target electrode 164 is less than 1 millimeter.

Shortest maximum distance d3, being less than 1 millimeter, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2B and 2C for illustrative purposes only and not by way of limitation, the following portion of this paragraph delineates example nineteen of the subject-matter, disclosed herein. According to example nineteen, which encompasses any one of examples one to fourteen, above, shortest maximum distance d3 between transitional electrode 162 and target electrode 164 is less than 100 micrometers.

Shortest maximum distance d3, being less than 100 micrometers, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2B and 2C for illustrative purposes only and not by way of limitation, the following portion of this paragraph delineates example twenty of the subject-matter, disclosed herein. According to example twenty, which encompasses any one of examples one to fourteen, above, shortest maximum distance d3 between transitional electrode 162 and target electrode 164 is less than 20 micrometers.

Shortest maximum distance d3, being less than 20 micrometers, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring to FIGS. 2A-2C for illustrative purposes only and not by way of limitation, the following portion of this paragraph delineates example twenty-one of the subject-matter, disclosed herein. According to example twenty-one, which encompasses any one of examples one to twenty, above, shortest maximum distance d1 between initial electrode 160 and transitional electrode 162 is less than 15 centimeters.

Shortest maximum distance d1, being less than 15 centimeters, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example twenty-two of the subject-matter, disclosed herein. According to example twenty-two, which encompasses any one of examples one to twenty, above, shortest maximum distance d1 between initial electrode 160 and transitional electrode 162 is less than 5 millimeters.

Shortest maximum distance d1, being less than 5 millimeters, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example twenty-three of the subject-matter, disclosed herein. According to example twenty-three, which encompasses any one of examples one to twenty, above, shortest maximum distance d1 between initial electrode 160 and transitional electrode 162 is less than 2 millimeters.

Shortest maximum distance d1, being less than 2 millimeters, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example twenty-four of the subject-matter, disclosed herein. According to example twenty-four, which encompasses any one of examples one to twenty, above, shortest maximum distance d1 between initial electrode 160 and transitional electrode 162 is less than 1 millimeter.

Shortest maximum distance d1, being less than 1 millimeter, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example twenty-five of the subject-matter, disclosed herein. According to example twenty-five, which encompasses any one of examples one to twenty, above, shortest maximum distance d1 between initial electrode 160 and transitional electrode 162 is less than 100 micrometers.

Shortest maximum distance d1, being less than 100 micrometers, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example twenty-six of the subject-matter, disclosed herein. According to example twenty-six, which encompasses any one of examples one to twenty, above, shortest maximum distance d1 between initial electrode 160 and transitional electrode 162 is less than 10 micrometers.

Shortest maximum distance d1, being less than 10 micrometers, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 1B, 1C, and 2A-2C for illustrative purposes only and not by way of limitation, the following portion of this paragraph delineates example twenty-seven of the subject-matter, disclosed herein. According to example twenty-seven, which encompasses any one of examples one to twenty-six, above, the first electric current, passing through electrolytic solution 222, initial electrode 160, and transitional electrode 162, is established by an electric potential difference between initial electrode 160 and transitional electrode 162. The second electric current, passing through electrolytic solution 222, transitional electrode 162, and target electrode 164, is established by an electric potential difference between target electrode 164 and transitional electrode 162. The electric potential difference between initial electrode 160 and transitional electrode 162 is greater than the electric potential difference between target electrode 164 and transitional electrode 162.

The electric potential difference between initial electrode 160 and transitional electrode 162, being greater than the electric potential difference between target electrode 164 and transitional electrode 162, helps ensure that electrode material of transitional electrode 162 is not dissolved into electrolytic solution 222 when the electrically neutral material from deposit 166 is converted to a quantity of the electrically charged material, which is dissolved into electrolytic solution 222.

Referring to FIGS. 1B, 1C, and 2A-2C for illustrative purposes only and not by way of limitation, the following portion of this paragraph delineates example twenty-eight of the subject-matter, disclosed herein. According to example twenty-eight, which encompasses example twenty-seven, above, the electric potential difference between initial electrode 160 and transitional electrode 162 is above 2V, and the electric potential difference between target electrode 164 and transitional electrode 162 is below 1V.

The electric potential difference between initial electrode 160 and transitional electrode 162, being above 2V, and the electric potential difference between target electrode 164 and transitional electrode 162, being below 1V helps ensure that electrode material of transitional electrode 162 is not dissolved into electrolytic solution 222 when the electrically neutral material from deposit 166 is converted to a quantity of the electrically charged material, which is dissolved into electrolytic solution 222.

Referring to FIGS. 1D, 1E, and 2A-2C for illustrative purposes only and not by way of limitation, the following portion of this paragraph delineates example twenty-nine of the subject-matter, disclosed herein. According to example twenty-nine, which encompasses any one of examples one to twenty-seven, above, the first electric current, passing through electrolytic solution 222, initial electrode 160, and transitional electrode 162, is established by an electric potential difference between initial electrode 160 and transitional electrode 162. The third electric current, passing through second electrolytic solution 226, transitional electrode 162, and target electrode 164, is established by an electric potential difference between target electrode 164 and transitional electrode 162. The electric potential difference between initial electrode 160 and transitional electrode 162 is greater than the electric potential difference between target electrode 164 and transitional electrode 162.

The electric potential difference between initial electrode 160 and transitional electrode 162, being greater than the electric potential difference between target electrode 164 and transitional electrode 162 helps ensure that electrode material of transitional electrode 162 is not dissolved into second electrolytic solution 226 when the electrically neutral material from deposit 166 is converted to a quantity of the electrically charged material, which is dissolved into second electrolytic solution 226.

Referring to FIGS. 1D, 1E, and 2A-2C for illustrative purposes only and not by way of limitation, the following portion of this paragraph delineates example thirty of the subject-matter, disclosed herein. According to example thirty, which encompasses example twenty-nine, above, the electric potential difference between initial electrode 160 and transitional electrode 162 is above 2V, and the electric potential difference between target electrode 164 and transitional electrode 162 is below 1V.

The electric potential difference between initial electrode 160 and transitional electrode 162, being above 2V, and the electric potential difference between target electrode 164 and transitional electrode 162, being below 1V helps ensure that electrode material of transitional electrode 162 is not dissolved into second electrolytic solution 226 when the electrically neutral material from deposit 166 is converted to a quantity of the electrically charged material, which is dissolved into second electrolytic solution 226.

Referring to FIGS. 1D, 1E, and 2A-2C for illustrative purposes only and not by way of limitation, the following portion of this paragraph delineates example thirty-one of the subject-matter, disclosed herein. According to example thirty-one, which encompasses any one of examples one to thirty, above, initial electrode 160 and transitional electrode 162 have different surface areas.

Initial electrode 160 and transitional electrode 162, having different surface areas, enables initial electrode 160 to be a stand-alone electrode, separate from printhead 101.

Referring to FIGS. 1D, 1E, and 2A-2C for illustrative purposes only and not by way of limitation, the following portion of this paragraph delineates example thirty-two of the subject-matter, disclosed herein. According to example thirty-two, which encompasses example thirty-one, above, initial electrode 160 has a greater surface area than transitional electrode 162.

Initial electrode 160, having a greater surface area than transitional electrode 162, facilitates electroplating of electrically neutral material, as deposit 166, on the surface of multiple transitional electrodes 162 using initial electrode 160. Additionally, initial electrode 160, having a greater surface area than transitional electrode 162 promotes the longevity of initial electrode 160.

Referring to FIGS. 1A-2C for illustrative purposes only and not by way of limitation, the following portion of this paragraph delineates example thirty-three of the subject-matter, disclosed herein. According to example thirty-three, which encompasses any one of examples one to thirty-two, above, the second electric current is established through electrolytic solution 222, transitional electrode 162, and target electrode 164 when electrolytic solution 222 is in direct physical contact with a surface of at least a portion of transitional electrode 162, which has a greater area than the surface of at least the portion of transitional electrode 162, onto which the electrically neutral material is electroplated as deposit 166. The third electric current is established through second electrolytic solution 226, transitional electrode 162, and target electrode 164 when second electrolytic solution 226 is in direct physical contact with a surface of at least a portion of transitional electrode 162, which has a greater area than the surface of at least the portion of transitional electrode 162, onto which the electrically neutral material is electroplated as deposit 166.

Electrolytic solution 222 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into electrolytic solution 222. Second electrolytic solution 226 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into second electrolytic solution 226.

Referring to FIG. 2A for illustrative purposes only and not by way of limitation, the following portion of this paragraph delineates example thirty-four of the subject-matter, disclosed herein. According to example thirty-four, which encompasses example one, above, electrochemical-deposition apparatus 100 further comprises electrodes 168, couplable with electric-power supply circuit 141. Electrodes 168, initial electrode 160, transitional electrode 162, and target electrode 164 are individually addressable and form electrode array 170 of printhead 101. Electrodes 168, initial electrode 160, transitional electrode 162, and target electrode 164 are made of an electrode material.

Implementing electrodes 168, initial electrode 160, transitional electrode 162, and target electrode 164 as electrode array 170 of printhead 101 provides electrochemical-deposition apparatus 100 with enhanced operational capabilities, such as highly granular control of current density over a predefined area for additive manufacturing of articles, having complex geometries and/or different material compositions.

Referring to FIGS. 1A-2C for illustrative purposes only and not by way of limitation, the following portion of this paragraph delineates example thirty-five of the subject-matter, disclosed herein. According to example thirty-five, electrochemical-deposition apparatus 110 comprises initial electrode 160, transitional electrode 162, and electric-power supply circuit 141, electrically couplable with initial electrode 160 and transitional electrode 162. The electrochemical-deposition apparatus additionally comprises controller 122, which is configured to, sequentially, (1) direct electric-power supply circuit 141 to establish a first electric current through electrolytic solution 222, initial electrode 160, and transitional electrode 162 when a surface of at least a portion of initial electrode 160 is in direct physical contact with electrolytic solution 222, and a surface of at least a portion of transitional electrode 162 is in direct physical contact with electrolytic solution 222, so that a quantity of an electrically charged material in electrolytic solution 222 is converted to a quantity of an electrically neutral material, which is electroplated, as deposit 166, onto the surface of at least the portion of transitional electrode 162, (2) direct electric-power supply circuit 141 to terminate the first electric current through electrolytic solution 222, transitional electrode 162, and initial electrode 160, and (3) direct electric-power supply circuit 141 to either (i) establish second electric current through electrolytic solution 222, transitional electrode 162, and target electrode 164 when a surface of at least a portion of deposit 166 is in direct physical contact with electrolytic solution 222, and a surface of at least a portion of target electrode 164 is in direct physical contact with electrolytic solution 222, so that a quantity of the electrically neutral material from deposit 166 is converted to a quantity of the electrically charged material, which is dissolved into electrolytic solution 222, and a quantity of the electrically charged material in electrolytic solution 222 is converted to a quantity of the electrically neutral material, which is electroplated onto the surface of at least the portion of target electrode 164, or (ii) establish a third electric current through second electrolytic solution 226, transitional electrode 162, and target electrode 164 when a surface of at least a portion of deposit 166 is in direct physical contact with second electrolytic solution 226, and a surface of at least a portion of target electrode 164 is in direct physical contact with second electrolytic solution 226, so that a quantity of the electrically neutral material from deposit 166 is converted to a quantity of the electrically charged material, which is dissolved into second electrolytic solution 226, and one of (a) a quantity of the electrically charged material in second electrolytic solution 226 is converted to a quantity of the electrically neutral material, which is electroplated onto the surface of at least the portion of target electrode 164, or (b) a quantity of a second electrically charged material in second electrolytic solution 226 is converted to a quantity of a second electrically neutral material, which is electroplated onto the surface of at least the portion of target electrode 164.

Electrochemical-deposition apparatus 110 promotes a reduction in bubbles, generated in electrolytic solution 222 or second electrolytic solution 226 when the electrically neutral material or the second electrically neutral material is electroplated onto the surface of at least the portion of target electrode 164. Converting the electrically neutral material from deposit 166 to the quantity of electrically charged material in electrolytic solution 222 or second electrolytic solution 226 enables an electric current, sufficient to deposit the electrically neutral material or the second electrically neutral material onto target electrode 164, to flow through electrolytic solution 222 or second electrolytic solution 226 to target electrode 164 while generating little to no bubbles in electrolytic solution 222 or second electrolytic solution 226. Moreover, converting the quantity of the electrically charged material in electrolytic solution 222 to the quantity of the electrically neutral material and then electroplating, as deposit 166, the quantity of the electrically neutral material onto the surface of at least the portion of transitional electrode 162, provides an efficient and reliable way to replenish the quantity of the electrically neutral material deposited on the transitional electrode 162.

In one or more examples, at least one of initial electrode 160, transitional electrode 162, and target electrode 164 can be made of copper or metals that are more electrochemically reactive than copper, such as aluminum, lead, nickel, tin, or zinc or can comprise copper or metals that are more electrochemically reactive than copper, such as aluminum, lead, nickel, tin, or zinc.

Referring to FIGS. 1A-2C for illustrative purposes only and not by way of limitation, the following portion of this paragraph delineates example thirty-six of the subject-matter, disclosed herein. According to example thirty-six, which encompasses example thirty-five, above, initial electrode 160 comprises a quantity of an electrode material, and transitional electrode 162 comprises a quantity of the electrode material.

In one or more examples, initial electrode 160 and transitional electrode 162, comprising a quantity of the electrode material enables initial electrode 160 and transitional electrode 162 to contain the same electrically conductive material, which promotes simplicity in manufacturing, assembling, and operating electrochemical-deposition apparatus 100.

Referring to FIGS. 1B-1E for illustrative purposes only and not by way of limitation, the following portion of this paragraph delineates example thirty-seven of the subject-matter, disclosed herein. According to example thirty-seven, which encompasses example thirty-six, above, the electrically neutral material and the electrode material have different chemical compositions.

In one or more examples, the electrically neutral material and the electrode material, having different chemical compositions, enable one material to be deposited on transitional electrode 162, made of another material.

Referring to FIGS. 1B-1E for illustrative purposes only and not by way of limitation, the following portion of this paragraph delineates example thirty-eight of the subject-matter, disclosed herein. According to example thirty-eight, which encompasses example thirty-six or thirty-seven, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material. In one example, the electrically neutral material is less noble than the electrode material.

Referring to FIGS. 1B-1E and 2C for illustrative purposes only and not by way of limitation, the following portion of this paragraph delineates example thirty-nine of the subject-matter, disclosed herein. According to example thirty-nine, which encompasses example thirty-five, above, transitional electrode 162 comprises a quantity of an electrode material, and initial electrode 160 comprises a quantity of a second electrode material. The second electrode material is more electrochemically reactive than the electrode material.

The second electrode material of initial electrode 160, being more electrochemically reactive than the electrode material of transitional electrode 162, enables second electrode material of initial electrode 160 to be dissolved in electrolytic solution 222 when the first electric current is directed through electrolytic solution 222, initial electrode 160, and transitional electrode 162.

Referring to FIGS. 1B-1E and 2C for illustrative purposes only and not by way of limitation, the following portion of this paragraph delineates example forty of the subject-matter, disclosed herein. According to example forty, which encompasses example thirty-five, above, transitional electrode 162 consists of a quantity of an electrode material, and initial electrode 160 consists of a quantity of a second electrode material. The second electrode material is more electrochemically reactive than the electrode material.

The second electrode material of initial electrode 160, being more electrochemically reactive than the electrode material of transitional electrode 162, enables second electrode material of initial electrode 160 to be dissolved in electrolytic solution 222 when the first electric current is directed through electrolytic solution 222, initial electrode 160, and transitional electrode 162.

Referring to FIGS. 1A-2C for illustrative purposes only and not by way of limitation, the following portion of this paragraph delineates example forty-one of the subject-matter, disclosed herein. According to example forty-one, which encompasses example thirty-five, above, initial electrode 160 consists of a quantity of an electrode material, and transitional electrode 162 consists of a quantity of the electrode material.

Initial electrode 160 and transitional electrode 162, consisting of a quantity of the electrode material, enables initial electrode 160 and transitional electrode 162 to be more easily manufactured, assembled, and operated.

Referring to FIGS. 1B-1E for illustrative purposes only and not by way of limitation, the following portion of this paragraph delineates example forty-two of the subject-matter, disclosed herein. According to example forty-two, which encompasses example forty-one, above, the electrically neutral material and the electrode material have different chemical compositions.

In one or more examples, the electrically neutral material and the electrode material, having different chemical compositions, enable one material to be deposited on transitional electrode 162, made of another material.

Referring to FIGS. 1B-1E for illustrative purposes only and not by way of limitation, the following portion of this paragraph delineates example forty-three of the subject-matter, disclosed herein. According to example forty-three, which encompasses example forty-one or forty-two, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material.

Referring to FIGS. 1A-2C for illustrative purposes only and not by way of limitation, the following portion of this paragraph delineates example forty-four of the subject-matter, disclosed herein. According to example forty-four, which encompasses any one of examples thirty-five to forty-three, above, controller 122 is configured to direct electric-power supply circuit 141 to establish the first electric current through electrolytic solution 222, initial electrode 160, and transitional electrode 162 and also to direct electric-power supply circuit 141 to either establish the second electric current through electrolytic solution 222, transitional electrode 162, and target electrode 164, or to establish the third electric current through second electrolytic solution 226, transitional electrode 162, and target electrode 164, such that a rate of electroplating the quantity of the electrically neutral material onto the surface of at least the portion of transitional electrode 162 is higher than a rate of electroplating the quantity of the electrically neutral material in electrolytic solution 222 or in second electrolytic solution 226 onto the surface of at least the portion of target electrode 164.

The rate of electroplating the quantity of the electrically neutral material onto the surface of at least the portion of transitional electrode 162, being higher than the rate of electroplating the quantity of the electrically neutral material onto the surface of at least the portion of target electrode 164 helps to quickly replenish deposit 166 with electrically neutral material in advance of the quantity of the electrically neutral material or the second electrically neutral material being electroplated onto the surface of at least the portion of the target electrode 164. In some examples, because the quality of deposit 166 can be lower than the quality of the electrically neutral material or second electrically neutral material electroplated onto the surface of at least the portion of target electrode 164, the rate of electroplating the quantity of the electrically neutral material onto the surface of at least the portion of transitional electrode 162 can be higher than the rate of electroplating the quantity of the electrically neutral material onto the surface of at least the portion of target electrode 164.

Referring to FIGS. 2A-2C for illustrative purposes only and not by way of limitation, the following portion of this paragraph delineates example forty-five of the subject-matter, disclosed herein. According to example forty-five, which encompasses any one of examples thirty-five to forty-four, above, shortest maximum distance d1 between initial electrode 160 and transitional electrode 162 is less than 15 centimeters.

Shortest maximum distance d1, being less than 15 centimeters, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example forty-six of the subject-matter, disclosed herein. According to example forty-six, which encompasses any one of examples thirty-five to forty-four, above, shortest maximum distance d1 between initial electrode 160 and transitional electrode 162 is less than 5 millimeters.

In one or more examples, shortest maximum distance d1, being less than 5 millimeters, promotes electroplating of the quantity of the electrically neutral material, as deposit 166, onto transitional electrode 162 in an efficient manner and helps to avoid skip-plating of the electrically neutral material onto target electrode 164 in view of the specific dimensions of the components of the electroplating cell, in which material deposition is taking place.

Referring to FIGS. 2A-2C for illustrative purposes only and not by way of limitation, the following portion of this paragraph delineates example forty-seven of the subject-matter, disclosed herein. According to example forty-seven, which encompasses any one of examples thirty-five to forty-four, above, shortest maximum distance d1 between initial electrode 160 and transitional electrode 162 is less than 2 millimeters.

In one or more examples, shortest maximum distance d1, being less than 2 millimeters, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example forty-eight of the subject-matter, disclosed herein. According to example forty-eight, which encompasses any one of examples thirty-five to forty-four, above, shortest maximum distance d1 between initial electrode 160 and transitional electrode 162 is less than 1 millimeter.

In one or more examples, shortest maximum distance d1, being less than 1 millimeter, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example forty-nine of the subject-matter, disclosed herein. According to example forty-nine, which encompasses any one of examples thirty-five to forty-four, above, shortest maximum distance d1 between initial electrode 160 and transitional electrode 162 is less than 100 micrometers centimeters.

In one or more examples, shortest maximum distance d1, being less than 100 micrometers, promotes electroplating of the quantity of the electrically neutral material, as deposit 166, onto transitional electrode 162 in an efficient manner in view of the specific dimensions of the components of the electroplating cell, in which material deposition is taking place.

Referring to FIGS. 2A-2C for illustrative purposes only and not by way of limitation, the following portion of this paragraph delineates example fifty of the subject-matter, disclosed herein. According to example fifty, which encompasses any one of examples thirty-five to forty-four, above, shortest maximum distance d1 between initial electrode 160 and transitional electrode 162 is less than 10 micrometers.

In one or more examples, shortest maximum distance d1, being less than 10 micrometers, promotes electroplating of the quantity of the electrically neutral material, as deposit 166, onto transitional electrode 162 in an efficient manner and in view of the specific dimensions of the components of the electroplating cell, in which material deposition is taking place.

Referring to FIGS. 1B, 1C, and 2A-2C for illustrative purposes only and not by way of limitation, the following portion of this paragraph delineates example fifty-one of the subject-matter, disclosed herein. According to example fifty-one, which encompasses any one of examples thirty-five to fifty, above, the second electric current is established through electrolytic solution 222, transitional electrode 162, and target electrode 164 when electrolytic solution 222 is in direct physical contact with a surface of at least a portion of transitional electrode 162, which has a greater area than the surface of at least the portion of transitional electrode 162, onto which the electrically neutral material is electroplated as deposit 166. The third electric current is established through second electrolytic solution 226, transitional electrode 162, and target electrode 164 when second electrolytic solution 226 is in direct physical contact with a surface of at least a portion of transitional electrode 162, which has a greater area than the surface of at least the portion of transitional electrode 162, onto which the electrically neutral material is electroplated as deposit 166.

Electrolytic solution 222 being in direct physical contact with a surface of at least a portion of transitional electrode 162, which has a greater area than the surface of at least the portion of transitional electrode 162 onto which the electrically neutral material is electroplated as deposit 166 enables variability in the degree of submersion of transitional electrode 162 into electrolytic solution 222. Second electrolytic solution 226 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into second electrolytic solution 226.

Referring generally to FIG. 2B for illustrative purposes only and not by way of limitation, the following portion of this paragraph delineates example fifty-two of the subject-matter, disclosed herein. According to example fifty-two, which encompasses any one of examples thirty-five to fifty-one, above, electrochemical-deposition apparatus 110 further comprises plurality of electrodes 172, couplable with electric-power supply circuit 141. Plurality of electrodes 172, initial electrode 160, and transitional electrode 162 are individually addressable and form electrode array 174 of printhead 103. Plurality of electrodes 172, initial electrode 160, and transitional electrode 162 are made of an electrode material.

Plurality of electrodes 172, initial electrode 160, and transitional electrode 162, forming electrode array 174 of printhead 101, enable co-movement of electrodes of printhead 103 and ease in assembly, set-up, and operation of electrochemical-deposition apparatus 100, as well as highly granular control of current density over a predefined area for additive manufacturing of articles, having complex geometries and/or different material compositions.

Referring to FIG. 2C for illustrative purposes only and not by way of limitation, the following portion of this paragraph delineates example fifty-three of the subject-matter, disclosed herein. According to example fifty-three, electrochemical-deposition apparatus 120 comprises printhead 105, comprising a plurality of individually addressable transitional electrodes 180. Electrochemical-deposition apparatus 120 also comprises electric-power supply circuit 141, electrically couplable with at least one of individually addressable transitional electrodes 180. Electrochemical-deposition apparatus 120 further comprises controller 122, which is configured to, sequentially, (1) direct electric-power supply circuit 141 to establish a first electric current through electrolytic solution 222, initial electrode 160, and at least one of individually addressable transitional electrodes 180 when a surface of at least a portion of initial electrode 160 is in direct physical contact with electrolytic solution 222, and a surface of at least a portion of at least the one of individually addressable transitional electrodes 180 is in direct physical contact with electrolytic solution 222, so that a quantity of an electrically charged material in electrolytic solution 222 is converted to a quantity of an electrically neutral material, which is electroplated, as deposit 166, onto the surface of at least the portion of at least the one of individually addressable transitional electrodes 180, (2) direct electric-power supply circuit 141 to terminate the first electric current through electrolytic solution 222, at least the one of individually addressable transitional electrodes 180, and initial electrode 160, and (3) direct electric-power supply circuit 141 to either (a) establish a second electric current through electrolytic solution 222, at least the one of plurality of individually addressable transitional electrodes 180, and target electrode 164 when a surface of at least a portion of deposit 166 is in direct physical contact with electrolytic solution 222, and a surface of at least a portion of target electrode 164 is in direct physical contact with electrolytic solution 222, so that a quantity of the electrically neutral material from deposit 166 is converted to a quantity of the electrically charged material, which is dissolved into electrolytic solution 222, and a quantity of the electrically charged material in electrolytic solution 222 is converted to a quantity of the electrically neutral material, which is electroplated onto the surface of at least the portion of target electrode 164, or (b) establish a third electric current through second electrolytic solution 226, at least the one of plurality of individually addressable transitional electrodes 180, and target electrode 164 when a surface of at least a portion of deposit 166 is in direct physical contact with second electrolytic solution 226, and a surface of at least a portion of target electrode 164 is in direct physical contact with second electrolytic solution 226, so that a quantity of the electrically neutral material from deposit 166 is converted to a quantity of the electrically charged material, which is dissolved into second electrolytic solution 226, and one of (i) a quantity of the electrically charged material in second electrolytic solution 226 is converted to a quantity of the electrically neutral material, which is electroplated onto the surface of at least the portion of target electrode 164, or (ii) a quantity of a second electrically charged material in second electrolytic solution 226 is converted to a quantity of a second electrically neutral material, which is electroplated onto the surface of at least the portion of target electrode 164.

Electrochemical-deposition apparatus 120 promotes a reduction in bubbles, generated in electrolytic solution 222 or second electrolytic solution 226 when the electrically neutral material or the second electrically neutral material is electroplated onto the surface of at least the portion of target electrode 164. Converting the electrically neutral material from deposit 166 to the quantity of electrically charged material in electrolytic solution 222 or second electrolytic solution 226 enables an electric current, sufficient to deposit the electrically neutral material or the second electrically neutral material onto target electrode 164, to flow through electrolytic solution 222 or second electrolytic solution 226 to target electrode 164 while generating little to no bubbles in electrolytic solution 222 or second electrolytic solution 226. Moreover, converting the quantity of the electrically charged material in electrolytic solution 222 to the quantity of the electrically neutral material and then electroplating, as deposit 166, the quantity of the electrically neutral material onto the surface of at least the portion of at least the one of plurality of individually addressable transitional electrodes 180, provides an efficient and reliable way to replenish the quantity of the electrically neutral material deposited on at least the one of the plurality of individually addressable transitional electrodes 180.

As used herein, individually addressable transitional electrodes 180 can be thin-film transistor-based microelectrodes.

In one or more examples, at least one of initial electrode 160, at least one of plurality of individually addressable transitional electrodes 18, and target electrode 164 can be made of copper or metals that are more electrochemically reactive than copper, such as aluminum, lead, nickel, tin, or zinc or can comprise copper or metals that are more electrochemically reactive than copper, such as aluminum, lead, nickel, tin, or zinc.

Referring to FIG. 2C for illustrative purposes only and not by way of limitation, the following portion of this paragraph delineates example fifty-four of the subject-matter, disclosed herein. According to example fifty-four, which encompasses example fifty-three, above, at least the one of plurality of individually addressable transitional electrodes 180 comprises a quantity of an electrode material. The electrically neutral material and the electrode material have different chemical compositions.

In one or more examples, the electrically neutral material and the electrode material, having different chemical compositions, enable one material to be deposited on at least the one of plurality of individually addressable transitional electrodes 180, made of another material.

Referring to FIG. 2C for illustrative purposes only and not by way of limitation, the following portion of this paragraph delineates example fifty-five of the subject-matter, disclosed herein. According to example fifty-five, which encompasses example fifty-four, above, each one of plurality of individually addressable transitional electrodes 180 comprises a quantity of the electrode material.

Each one of plurality of individually addressable transitional electrodes 180, comprising a quantity of the electrode material, enables any one or more of plurality of individually addressable transitional electrodes 180 to have a quantity of the electrically neutral material electroplated thereon, as deposit 166. Additionally, each one of plurality of individually addressable transitional electrodes 180, comprising a quantity of the electrode material, promotes redundancy and reliability in operation of electrochemical-deposition apparatus 110.

Referring to FIG. 2C for illustrative purposes only and not by way of limitation, the following portion of this paragraph delineates example fifty-six of the subject-matter, disclosed herein. According to example fifty-six, which encompasses example fifty-four or fifty-five, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material.

Referring to FIG. 2C for illustrative purposes only and not by way of limitation, the following portion of this paragraph delineates example fifty-seven of the subject-matter, disclosed herein. According to example fifty-seven, which encompasses any one of examples fifty-four to fifty-six, above, the electrode material is less electrochemically reactive than copper.

The electrode material, being less electrochemically reactive than copper, promotes the sustainability and longevity of at least the one of plurality of individually addressable transitional electrodes 180 when the electrically neutral material comprises copper because copper would be more prone to converting to electrically charge material and dissolving into electrolytic solution 222 or second electrolytic solution 226 than the electrode material.

Referring to FIG. 2C for illustrative purposes only and not by way of limitation, the following portion of this paragraph delineates example fifty-eight of the subject-matter, disclosed herein. According to example fifty-eight, which encompasses example fifty-seven, above, the electrode material is one of platinum-group metals.

The electrode material, being one of platinum-group metals (i.e., iridium, osmium, palladium, platinum, rhodium, and ruthenium), promotes the sustainability and longevity of at least the one of plurality of individually addressable transitional electrodes 180 when the electrically neutral material comprises copper because copper would be more prone to converting to electrically charge material and dissolving into electrolytic solution 222 or second electrolytic solution 226 than platinum-group metals.

Referring to FIG. 2C for illustrative purposes only and not by way of limitation, the following portion of this paragraph delineates example fifty-nine of the subject-matter, disclosed herein. According to example fifty-nine, which encompasses example fifty-seven, above, the electrode material is one of platinum-group metals and/or corresponding oxides thereof.

The electrode material, being one of platinum-group metals and/or corresponding oxides thereof, promotes the sustainability and longevity of at least the one of plurality of individually addressable transitional electrodes 180 when the electrically neutral material comprises copper because copper would be more prone to converting to electrically charged material and dissolving into electrolytic solution 222 or second electrolytic solution 226 than platinum-group metals and/or corresponding oxides thereof.

Referring to FIG. 2C for illustrative purposes only and not by way of limitation, the following portion of this paragraph delineates example sixty of the subject-matter, disclosed herein. According to example sixty, which encompasses example fifty-three, above, at least the one of plurality of individually addressable transitional electrodes 180 consists of a quantity of an electrode material. The electrically neutral material and the electrode material have different chemical compositions.

In one or more examples, the electrically neutral material and the electrode material, having different chemical compositions, enable one material to be deposited on at least the one of plurality of individually addressable transitional electrodes 180, made of another material.

Referring to FIG. 2C for illustrative purposes only and not by way of limitation, the following portion of this paragraph delineates example sixty-one of the subject-matter, disclosed herein. According to example sixty-one, which encompasses example sixty, above, each one of plurality of individually addressable transitional electrodes 180 consists of a quantity of the electrode material.

Each one of plurality of individually addressable transitional electrodes 180, consisting of a quantity of the electrode material, enables any one or more of plurality of individually addressable transitional electrodes 180 to have a quantity of the electrically neutral material electroplated thereon, as deposit 166. Additionally, each one of plurality of individually addressable transitional electrodes 180, consisting of a quantity of the electrode material, promotes redundancy and reliability in operation of electrochemical-deposition apparatus 110.

Referring to FIG. 2C for illustrative purposes only and not by way of limitation, the following portion of this paragraph delineates example sixty-two of the subject-matter, disclosed herein. According to example sixty-two, which encompasses example sixty or sixty-one, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 or second electrolytic solution 226 without affecting the electrode material.

Referring to FIG. 2C for illustrative purposes only and not by way of limitation, the following portion of this paragraph delineates example sixty-three of the subject-matter, disclosed herein. According to example sixty-three, which encompasses any one of examples sixty to sixty-two, above, the electrode material is less electrochemically reactive than copper.

The electrode material, being less electrochemically reactive than copper, promotes the sustainability and longevity of at least the one of plurality of individually addressable transitional electrodes 180 when the electrically neutral material comprises copper because copper would be more prone to converting to electrically charged material and dissolving into electrolytic solution 222 or second electrolytic solution 226 than the electrode material.

Referring to FIG. 2C for illustrative purposes only and not by way of limitation, the following portion of this paragraph delineates example sixty-four of the subject-matter, disclosed herein. According to example sixty-four, which encompasses example sixty-three, above, the electrode material is one of platinum-group metals and/or corresponding oxides thereof.

The electrode material, being one of platinum-group metals and/or corresponding oxides thereof, promotes the sustainability and longevity of at least the one of plurality of individually addressable transitional electrodes 180 when the electrically neutral material comprises copper because copper would be more prone to converting to electrically charged material and dissolving into electrolytic solution 222 or second electrolytic solution 226 than platinum-group metals and/or corresponding oxides thereof.

Referring to FIG. 2C for illustrative purposes only and not by way of limitation, the following portion of this paragraph delineates example sixty-five of the subject-matter, disclosed herein. According to example sixty-five, which encompasses example fifty-three, above, at least the one of the plurality of individually addressable transitional electrodes 180 is made of one of aluminum, copper, lead, nickel, tin, or zinc.

The use of the above-mentioned example electrode materials enables the manufacturing costs of printhead 105 to be decreased.

Referring to FIG. 2C for illustrative purposes only and not by way of limitation, the following portion of this paragraph delineates example sixty-six of the subject-matter, disclosed herein. According to example sixty-six, which encompasses any one of examples fifty-three to sixty-five, above, controller 122 is configured to direct electric-power supply circuit 141 to establish the first electric current through electrolytic solution 222, initial electrode 160, and at least the one of the plurality of individually addressable transitional electrodes 180 and also to direct electric-power supply circuit 141 to either establish the second electric current through electrolytic solution 222, at least the one of plurality of individually addressable transitional electrodes 180, and target electrode 164, or to establish the third electric current through second electrolytic solution 226, at least the one of plurality of individually addressable transitional electrodes 180, and target electrode 164, such that a rate of electroplating the quantity of the electrically neutral material onto the surface of at least the portion of at least the one of plurality of individually addressable transitional electrodes 180 is higher than a rate of electroplating the quantity of the electrically neutral material in electrolytic solution 222 or in second electrolytic solution 226 onto the surface of at least the portion of target electrode 164.

The rate of electroplating the quantity of the electrically neutral material onto the surface of at least the portion of at least the one of plurality of individually addressable transitional electrodes 180, being higher than the rate of electroplating the quantity of the electrically neutral material onto the surface of at least the portion of target electrode 164 helps to quickly replenish deposit 166 with electrically neutral material in advance of the quantity of the electrically neutral material or the second electrically neutral material being electroplated onto the surface of at least the portion of target electrode 164. In some examples, because the quality of deposit 166 can be lower than the quality of the electrically neutral material or second electrically neutral material electroplated onto the surface of at least the portion of target electrode 164, the rate of electroplating the quantity of the electrically neutral material onto the surface of at least the portion of at least the one of plurality of individually addressable transitional electrodes 180 can be higher than the rate of electroplating the quantity of the electrically neutral material onto the surface of at least the portion of target electrode 164.

Referring to FIG. 2C for illustrative purposes only and not by way of limitation, the following portion of this paragraph delineates example sixty-seven of the subject-matter, disclosed herein. According to example sixty-seven, which encompasses any one of examples fifty-three to sixty-six, above, the second electric current is established through electrolytic solution 222, at least the one of plurality of individually addressable transitional electrodes 180, and target electrode 164 when electrolytic solution 222 is in direct physical contact with a surface of at least a portion of at least the one of plurality of individually addressable transitional electrodes 180, which has a greater area than the surface of at least the portion of at least the one of plurality of individually addressable transitional electrodes 180, onto which the electrically neutral material is electroplated as deposit 166.

Electrolytic solution 222 being in direct physical contact with a surface of at least a portion of at least the one of plurality of individually addressable transitional electrodes 180, which has a greater area than the surface of at least the portion of at least the one of plurality of individually addressable transitional electrodes 180, onto which the electrically neutral material is electroplated as deposit 166, enables variability in the degree of submersion of at least the one of plurality of individually addressable transitional electrodes 180 into electrolytic solution 222.

Referring to FIG. 2C for illustrative purposes only and not by way of limitation, the following portion of this paragraph delineates example sixty-eight of the subject-matter, disclosed herein. According to example sixty-eight, which encompasses example sixty-seven, above, the third electric current is established through second electrolytic solution 226, at least the one of plurality of individually addressable transitional electrodes 180, and target electrode 164 when second electrolytic solution 226 is in direct physical contact with a surface of at least a portion of at least the one of plurality of individually addressable transitional electrodes 180, which has a greater area than the surface of at least the portion of at least the one of plurality of individually addressable transitional electrodes 180, onto which the electrically neutral material is electroplated as deposit 166.

Electrolytic solution 222 being in direct physical contact with a surface of at least a portion of at least the one of plurality of individually addressable transitional electrodes 180, which has a greater area than the surface of at least the portion of at least the one of plurality of individually addressable transitional electrodes 180, onto which the electrically neutral material is electroplated as deposit 166, enables variability in the degree of submersion of at least the one of plurality of individually addressable transitional electrodes 180 into second electrolytic solution 226.

Referring to FIG. 2C for illustrative purposes only and not by way of limitation, the following portion of this paragraph delineates example sixty-nine of the subject-matter, disclosed herein. According to example sixty-nine, which encompasses any one of examples fifty-three to sixty-eight, above, shortest maximum distance d2 between adjacent ones of plurality of individually addressable transitional electrodes 180 is less than 100 micrometers.

In one or more examples, shortest maximum distance d2 between adjacent ones of plurality of individually addressable transitional electrodes 180, being less than 100 micrometers, enables precise and high-resolution deposition of electrically neutral material onto the surface of at least the portion of target electrode 164.

Referring to FIG. 2C for illustrative purposes only and not by way of limitation, the following portion of this paragraph delineates example seventy of the subject-matter, disclosed herein. According to example seventy, which encompasses any one of examples fifty-three to sixty-nine, above, shortest maximum distance d1 between adjacent ones of plurality of individually addressable transitional electrodes 180 is less than 50 micrometers.

In one or more examples, shortest maximum distance d2 between adjacent ones of plurality of individually addressable transitional electrodes 180, being less than 50 micrometers, enables precise and high-resolution deposition of electrically neutral material onto the surface of at least the portion of target electrode 164.

Referring to FIG. 2C for illustrative purposes only and not by way of limitation, the following portion of this paragraph delineates example seventy-one of the subject-matter, disclosed herein. According to example seventy-one, which encompasses any one of examples fifty-three to seventy, above, shortest maximum distance d1 between adjacent ones of plurality of individually addressable transitional electrodes 180 is less than 10 micrometers.

Referring to FIG. 2C for illustrative purposes only and not by way of limitation, the following portion of this paragraph delineates example seventy-two of the subject-matter, disclosed herein. According to example seventy-two, which encompasses any one of examples fifty-three to seventy-one, above, any two of plurality of individually addressable transitional electrodes 180 have identical surface areas.

Any two of plurality of individually addressable transitional electrodes 180, having identical surface areas, promotes redundancy and consistency in depositing the electrically neutral material or the second electrically neutral material onto target electrode 164.

In one or more examples, shortest maximum distance d2 between adjacent ones of plurality of individually addressable transitional electrodes 180, being less than 10 micrometers, enables precise and high-resolution deposition of electrically neutral material onto the surface of at least the portion of target electrode 164.

Referring generally to FIG. 3 and particularly to FIGS. 1A-1C and 2A-2C for illustrative purposes only and not by way of limitation, the following portion of this paragraph delineates example seventy-three of the subject-matter, disclosed herein. According to example seventy-three, method 400 of electroplating at least a portion of target electrode 164 comprises a step of (block 402) establishing a first electric current through (1) electrolytic solution 222, comprising a quantity of an electrically charged material, (2) initial electrode 160, a surface of at least a portion of which is in direct physical contact with electrolytic solution 222, and (3) transitional electrode 162, a surface of at least a portion of which is in direct physical contact with electrolytic solution 222, so that a quantity of the electrically charged material in electrolytic solution 222 is converted to a quantity of an electrically neutral material, which is electroplated, as deposit 166, onto the surface of at least the portion of transitional electrode 162. Method 400 also comprises (block 404) terminating the first electric current through electrolytic solution 222, initial electrode 160, and transitional electrode 162. Method 400 further comprises (block 408) establishing a second electric current through electrolytic solution 222, transitional electrode 162, and target electrode 164, a surface of at least the portion of which is in direct physical contact with electrolytic solution 222, so that a quantity of the electrically neutral material from deposit 166, formed on the surface of at least the portion of transitional electrode 162, is converted to a quantity of the electrically charged material, which is dissolved into electrolytic solution 222, and a quantity of the electrically charged material in electrolytic solution 222 is converted to a quantity of the electrically neutral material, which is electroplated onto the surface of at least the portion of target electrode 164.

Method 400 promotes a reduction in bubbles, generated in electrolytic solution 222 when the electrically neutral material is electroplated onto the surface of at least the portion of target electrode 164. Converting the electrically neutral material from deposit 166 to the quantity of electrically charged material in electrolytic solution 222 enables an electric current, sufficient to deposit the electrically neutral material onto target electrode 164, to flow through electrolytic solution 222 to target electrode 164 while generating little to no bubbles in electrolytic solution 222. Moreover, converting the quantity of the electrically charged material in electrolytic solution 222 to the quantity of the electrically neutral material and then electroplating, as deposit 166, the quantity of the electrically neutral material onto the surface of at least the portion of transitional electrode 162, provides an efficient and reliable way to replenish the quantity of the electrically neutral material deposited on transitional electrode 162.

In one or more examples, at least one of initial electrode 160, transitional electrode 162, and target electrode 164 can be made of copper, or metals that are more electrochemically reactive than copper, such as aluminum, lead, nickel, tin, or zinc or can comprise copper, or metals that are more electrochemically reactive than copper, such as aluminum, lead, nickel, tin, or zinc.

Referring generally to FIG. 3 and particularly to FIG. 1C for illustrative purposes only and not by way of limitation, the following portion of this paragraph delineates example seventy-four of the subject-matter, disclosed herein. According to example seventy-four, which encompasses example seventy-three, above, method 400 further comprises a step of (block 406) establishing direct physical contact between the surface of at least the portion of target electrode 164 and electrolytic solution 222, performed after the step of terminating the first electric current through electrolytic solution 222, initial electrode 160, and transitional electrode 162.

Establishing direct physical contact between the surface of at least the portion of target electrode 164 and electrolytic solution 222, after terminating the first electric current through electrolytic solution 222, initial electrode 160, and transitional electrode 162, enables positioning target electrode 164 in any of various desirable locations without introducing risk of skip-plating the electrically neutral material onto target electrode 164.

Referring generally to FIG. 3 and particularly to FIG. 1C for illustrative purposes only and not by way of limitation, the following portion of this paragraph delineates example seventy-five of the subject-matter, disclosed herein. According to example seventy-five, which encompasses example seventy-four, above, the step of (block 406) establishing direct physical contact between the surface of at least the portion of target electrode 164 and electrolytic solution 222 is performed before the step of (block 408) establishing the second electric current through electrolytic solution 222, target electrode 164, and transitional electrode 162.

Establishing direct physical contact between the surface of at least the portion of target electrode 164 and electrolytic solution 222 before establishing the second electric current through electrolytic solution 222, target electrode 164, and transitional electrode 162 helps ensure target electrode 164 is properly positioned in electrolytic solution 222 to receive the electrically neutral material in the electroplating process initiated by establishing the second electric current.

Referring generally to FIG. 3 and particularly to FIG. 1C for illustrative purposes only and not by way of limitation, the following portion of this paragraph delineates example seventy-six of the subject-matter, disclosed herein. According to example seventy-six, which encompasses example seventy-four or seventy-five, above, the step of (block 406) establishing direct physical contact between the surface of at least the portion of target electrode 164 and electrolytic solution 222 comprises positioning target electrode 164 between initial electrode 160 and transitional electrode 162.

Positioning target electrode 164 between initial electrode 160 and transitional electrode 162 enables placement of target electrode 164 closer to transitional electrode 162, which promotes a higher-quality deposit of the electrically neutral material on target electrode 164.

Referring generally to FIG. 3 and particularly to FIG. 1C for illustrative purposes only and not by way of limitation, the following portion of this paragraph delineates example seventy-seven of the subject-matter, disclosed herein. According to example seventy-seven, which encompasses example seventy-four, above, when target electrode 164 is interposed between initial electrode 160 and transitional electrode 162, the step of (block 406) establishing direct physical contact between the surface of at least the portion of target electrode 164 and electrolytic solution 222 is performed after the step of terminating the first electric current through electrolytic solution 222, transitional electrode 162, and initial electrode 160.

Positioning target electrode 164 between initial electrode 160 and transitional electrode 162 after terminating the first electric current facilitates placement of target electrode 164 between initial electrode 160 and transitional electrode 162 without introducing risk of skip-plating the electrically neutral material onto target electrode 164.

Referring generally to FIG. 3 and particularly to FIGS. 1A-1C and 2A-2C for illustrative purposes only and not by way of limitation, the following portion of this paragraph delineates example seventy-eight of the subject-matter, disclosed herein. According to example seventy-eight, which encompasses any one of examples seventy-three to seventy-seven, above, a rate of forming deposit 166, electroplated onto the surface of at least the portion of transitional electrode 162, is higher than a rate electroplating the quantity of the electrically charged material in electrolytic solution 222 onto the surface of at least the portion of target electrode 164.

The rate of electroplating the quantity of the electrically neutral material onto the surface of at least the portion of transitional electrode 162, being higher than the rate of electroplating the quantity of the electrically neutral material onto the surface of at least the portion of target electrode 164, helps to quickly replenish deposit 166 with electrically neutral material in advance of the quantity of the electrically neutral material being electroplated onto the surface of at least the portion of target electrode 164. In some examples, because the quality of deposit 166 can be lower than the quality of the electrically neutral material electroplated onto the surface of at least the portion of target electrode 164, the rate of electroplating the quantity of the electrically neutral material onto the surface of at least the portion of transitional electrode 162 can be higher than the rate of electroplating the quantity of the electrically neutral material onto the surface of at least the portion of target electrode 164.

Referring generally to FIG. 3 and particularly to FIGS. 1A-1C and 2A-2C for illustrative purposes only and not by way of limitation, the following portion of this paragraph delineates example seventy-nine of the subject-matter, disclosed herein. According to example seventy-nine, which encompasses any one of examples seventy-three to seventy-eight, above, the first electric current, passing through electrolytic solution 222, initial electrode 160, and transitional electrode 162, is established by an electric potential difference between initial electrode 160 and transitional electrode 162. The second electric current, passing through electrolytic solution 222, transitional electrode 162, and target electrode 164, is established by an electric potential difference between target electrode 164 and transitional electrode 162. The electric potential difference between initial electrode 160 and transitional electrode 162 is greater than the electric potential difference between target electrode 164 and transitional electrode 162.

The electric potential difference between initial electrode 160 and transitional electrode 162, being greater than the electric potential difference between target electrode 164 and transitional electrode 162, helps ensure that electrode material of transitional electrode 162 is not dissolved into electrolytic solution 222 when the electrically neutral material from deposit 166 is converted to a quantity of the electrically charged material, which is dissolved into electrolytic solution 222.

Referring generally to FIG. 3 and particularly to FIGS. 1A-1C and 2A-2C for illustrative purposes only and not by way of limitation, the following portion of this paragraph delineates example eighty of the subject-matter, disclosed herein. According to example eighty, which encompasses example seventy-nine, above, the electric potential difference between initial electrode 160 and transitional electrode 162 is above 2V and the electric potential difference between target electrode 164 and transitional electrode 162 is below 1V.

The electric potential difference between initial electrode 160 and transitional electrode 162, being above 2V, and the electric potential difference between target electrode 164 and transitional electrode 162, being below 1V helps ensure that electrode material of transitional electrode 162 is not dissolved into electrolytic solution 222 when the electrically neutral material from deposit 166 is converted to a quantity of the electrically charged material, which is dissolved into electrolytic solution 222.

Referring generally to FIG. 3 and particularly to FIGS. 1A-1C and 2A-2C for illustrative purposes only and not by way of limitation, the following portion of this paragraph delineates example eighty-one of the subject-matter, disclosed herein. According to example eighty-one, which encompasses any one of examples seventy-three to eighty, above, initial electrode 160 comprises a quantity of an electrode material, and transitional electrode 162 comprises a quantity of the electrode material.

Initial electrode 160 and transitional electrode 162, comprising a quantity of the electrode material, enables initial electrode 160 and transitional electrode 162 to be made of the same material, which promotes simplicity in manufacturing, assembling, and operating an electrochemical-deposition apparatus that executes method 400. In some examples, the electrode material is an electrically conductive material.

Referring generally to FIG. 3 and particularly to FIGS. 1A-1C and 2A-2C for illustrative purposes only and not by way of limitation, the following portion of this paragraph delineates example eighty-two of the subject-matter, disclosed herein. According to example eighty-two, which encompasses example eighty-one, above, target electrode 164 comprises a quantity of the electrode material.

Target electrode 164, being made of a quantity of the electrode material, enables initial electrode 160, transitional electrode 162, and target electrode 164 to be made of the same material, which promotes simplicity in manufacturing, assembling, and operating an electrochemical-deposition apparatus that executes method 400.

Referring generally to FIG. 3 and particularly to FIGS. 1A-1C and 2A-2C for illustrative purposes only and not by way of limitation, the following portion of this paragraph delineates example eighty-three of the subject-matter, disclosed herein. According to example eighty-three, which encompasses example eighty-one or eighty-two, above, the electrically neutral material and the electrode material have different chemical compositions.

In one or more examples, the electrically neutral material and the electrode material, having different chemical compositions, enable one material to be deposited on transitional electrode 162, made of another material.

Referring generally to FIG. 3 and particularly to FIGS. 1A-1C and 2A-2C for illustrative purposes only and not by way of limitation, the following portion of this paragraph delineates example eighty-four of the subject-matter, disclosed herein. According to example eighty-four, which encompasses any one of examples eighty-one to eighty-three, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 without affecting the electrode material.

Referring generally to FIG. 3 and particularly to FIGS. 1A-1C and 2A-2C for illustrative purposes only and not by way of limitation, the following portion of this paragraph delineates example eighty-five of the subject-matter, disclosed herein. According to example eighty-five, which encompasses example eighty-one, above, target electrode 164 comprises a material, identical to that of deposit 166.

Material of target electrode 164, being identical to that of deposit 166, promotes the quality of the deposit of the electrically neutral material onto target electrode 164.

Referring generally to FIG. 3 and particularly to FIGS. 1A-1C and 2A-2C for illustrative purposes only and not by way of limitation, the following portion of this paragraph delineates example eighty-six of the subject-matter, disclosed herein. According to example eighty-six, which encompasses example eighty-five, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 without affecting the electrode material.

Referring generally to FIG. 3 and particularly to FIGS. 1A-1C and 2A-2C for illustrative purposes only and not by way of limitation, the following portion of this paragraph delineates example eighty-seven of the subject-matter, disclosed herein. According to example eighty-seven, which encompasses any one of examples seventy-three to eighty, above, initial electrode 160 consists of a quantity of an electrode material, and transitional electrode 162 consists of a quantity of the electrode material.

Initial electrode 160 and transitional electrode 162, consisting of a quantity of the electrode material, enables initial electrode 160 and transitional electrode 162 to be more easily manufactured, assembled, and operated.

Referring generally to FIG. 3 and particularly to FIGS. 1A-1C and 2A-2C for illustrative purposes only and not by way of limitation, the following portion of this paragraph delineates example eighty-eight of the subject-matter, disclosed herein. According to example eighty-eight, which encompasses example eighty-seven, above, target electrode 164 consists of a quantity of the electrode material.

Target electrode 164, consisting of a quantity of the electrode material, enables initial electrode 160, transitional electrode 162, and target electrode 164 to be made of the same material, which promotes simplicity in manufacturing, assembling, and operating an electrochemical-deposition apparatus that executes method 400.

Referring generally to FIG. 3 and particularly to FIGS. 1A-1C and 2A-2C for illustrative purposes only and not by way of limitation, the following portion of this paragraph delineates example eighty-nine of the subject-matter, disclosed herein. According to example eighty-nine, which encompasses example eighty-seven or eighty-eight, above, the electrically neutral material and the electrode material have different chemical compositions.

In one or more examples, the electrically neutral material and the electrode material, having different chemical compositions, enables one material to be deposited on transitional electrode 162, made of another material.

Referring generally to FIG. 3 and particularly to FIGS. 1A-1C and 2A-2C for illustrative purposes only and not by way of limitation, the following portion of this paragraph delineates example ninety of the subject-matter, disclosed herein. According to example ninety, which encompasses any one of examples eighty-seven to eighty-nine, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 without affecting the electrode material.

Referring generally to FIG. 3 and particularly to FIGS. 1A-1C and 2A-2C for illustrative purposes only and not by way of limitation, the following portion of this paragraph delineates example ninety-one of the subject-matter, disclosed herein. According to example ninety-one, which encompasses example eighty-seven, above, target electrode 164 comprises a material, identical to that of deposit 166.

Material of target electrode 164, being identical to that of deposit 166, promotes the quality of the deposit of the electrically neutral material onto target electrode 164.

Referring generally to FIG. 3 and particularly to FIGS. 1A-1C and 2A-2C for illustrative purposes only and not by way of limitation, the following portion of this paragraph delineates example ninety-two of the subject-matter, disclosed herein. According to example ninety-two, which encompasses example ninety-one, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into electrolytic solution 222 without affecting the electrode material.

Referring generally to FIG. 3 and particularly to FIGS. 1A-1E and 2C for illustrative purposes only and not by way of limitation, the following portion of this paragraph delineates example ninety-three of the subject-matter, disclosed herein. According to example ninety-three, which encompasses example seventy-three, above, initial electrode 160 comprises a quantity of a first electrode material, and transitional electrode 162 comprises a quantity of a second electrode material. The first electrode material is more electrochemically reactive than the second electrode material.

The first electrode material of initial electrode 160, being more electrochemically reactive than the second electrode material of transitional electrode 162, enables first electrode material of initial electrode 160 to be dissolved in electrolytic solution 222 when the first electric current is directed through electrolytic solution 222, initial electrode 160, and transitional electrode 162.

Referring generally to FIG. 3 and particularly to FIGS. 1A-1E and 2C for illustrative purposes only and not by way of limitation, the following portion of this paragraph delineates example ninety-four of the subject-matter, disclosed herein. According to example ninety-four, which encompasses example seventy-three, above, initial electrode 160 consists of a quantity of a first electrode material, and transitional electrode 162 consists of a quantity of a second electrode material. The first electrode material is more electrochemically reactive than the second electrode material.

The first electrode material of initial electrode 160, being more electrochemically reactive than the second electrode material of transitional electrode 162, enables first electrode material of initial electrode 160 to be dissolved in electrolytic solution 222 when the first electric current is directed through electrolytic solution 222, initial electrode 160, and transitional electrode 162.

Referring generally to FIG. 3 and particularly to FIGS. 2B and 2C for illustrative purposes only and not by way of limitation, the following portion of this paragraph delineates example ninety-five of the subject-matter, disclosed herein. According to example ninety-five, which encompasses any one of examples seventy-three to ninety-four, above, shortest maximum distance d3 between transitional electrode 162 and target electrode 164 is less than 5 millimeters.

In one or more examples, shortest maximum distance d3, being less than 5 millimeters, promotes electroplating of the quantity of the electrically neutral material onto the surface of target electrode 164 in an efficient and precise manner in view of the specific dimensions of the components of the electroplating cell, in which material deposition is taking place.

Referring generally to FIG. 3 and particularly to FIGS. 2A-2C for illustrative purposes only and not by way of limitation, the following portion of this paragraph delineates example ninety-six of the subject-matter, disclosed herein. According to example ninety-six, which encompasses any one of examples seventy-three to ninety-five, above, shortest maximum distance d1 between initial electrode 160 and transitional electrode 162 is less than 5 millimeters.

In one or more examples, shortest maximum distance d1, being less than 5 millimeters, promotes electroplating of the quantity of the electrically neutral material, as deposit 166, onto transitional electrode 162 in an efficient manner in view of the specific dimensions of the components of the electroplating cell, in which material deposition is taking place.

Referring generally to FIG. 3 and particularly to FIGS. 1A-1C and 2A-2C for illustrative purposes only and not by way of limitation, the following portion of this paragraph delineates example ninety-seven of the subject-matter, disclosed herein. According to example ninety-seven, which encompasses any one of examples seventy-three to ninety-six, above, the first electric current, passing through electrolytic solution 222, initial electrode 160, and transitional electrode 162, is terminated when deposit 166 reaches a predetermined size.

Terminating the first electric current, when deposit 166 reaches a predetermined size, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 3 and particularly to FIGS. 1A-1C and 2A-2C for illustrative purposes only and not by way of limitation, the following portion of this paragraph delineates example ninety-eight of the subject-matter, disclosed herein. According to example ninety-eight, which encompasses any one of examples seventy-three to ninety-six, above, the first electric current, passing through electrolytic solution 222, initial electrode 160, and transitional electrode 162, is terminated after a predetermined period of time has elapsed.

Terminating the first electric current, after the predetermined period of time has elapsed, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 3 and particularly to FIGS. 1A-1C and 2A-2C for illustrative purposes only and not by way of limitation, the following portion of this paragraph delineates example ninety-nine of the subject-matter, disclosed herein. According to example ninety-nine, which encompasses any one of examples seventy-three to ninety-six, above, the first electric current, passing through electrolytic solution 222, initial electrode 160, and transitional electrode 162, is terminated when a spatial distribution of deposit 166 reaches a predetermined spatial-distribution threshold.

Terminating the first electric current, when the spatial distribution of deposit 166 reaches a predetermined spatial-distribution threshold, helps ensure deposit 166 is large enough and is properly spatially distributed to effectively promote electroplating of electrically neutral material onto target electrode 164.

Referring generally to FIG. 3 and particularly to FIGS. 1A-1C and 2A-2C for illustrative purposes only and not by way of limitation, the following portion of this paragraph delineates example one hundred of the subject-matter, disclosed herein. According to example one hundred, which encompasses any one of examples seventy-three to ninety-six, above, the first electric current, passing through electrolytic solution 222, initial electrode 160, and transitional electrode 162, is terminated when the first electric current reaches a predetermined electric-current threshold.

Terminating the first electric current, when the first electric current reaches a predetermined electric-current threshold, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 3 and particularly to FIGS. 1A-1C and 2A-2C for illustrative purposes only and not by way of limitation, the following portion of this paragraph delineates example one hundred one of the subject-matter, disclosed herein. According to example one hundred one, which encompasses any one of examples seventy-three to ninety-six, above, the first electric current, passing through electrolytic solution 222, initial electrode 160, and transitional electrode 162, is established by an electric potential difference between initial electrode 160 and transitional electrode 162. The first electric current, passing through electrolytic solution 222, initial electrode 160, and transitional electrode 162, is terminated when the electric potential difference reaches a predetermined electric-potential-difference threshold.

Terminating the first electric current, when the electric potential difference reaches a predetermined electric-potential-difference threshold, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 3 and particularly to FIGS. 1B, 1C, and 2A-2C for illustrative purposes only and not by way of limitation, the following portion of this paragraph delineates example one hundred two of the subject-matter, disclosed herein. According to example one hundred two, which encompasses any one of examples seventy-three to one hundred one, above, the step of establishing the second electric current through electrolytic solution 222, transitional electrode 162, and target electrode 164 is performed when electrolytic solution 222 is in direct physical contact with a surface of at least a portion of transitional electrode 162, which has a greater area than the surface of at least the portion of transitional electrode 162, onto which the electrically neutral material is electroplated as deposit 166.

Electrolytic solution 222 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into electrolytic solution 222.

Referring generally to FIG. 4 and particularly to FIGS. 1D-2C for illustrative purposes only and not by way of limitation, the following portion of this paragraph delineates example one hundred three of the subject-matter, disclosed herein. According to example one hundred three, method 500 of electroplating at least a portion of target electrode 164 comprises a step of (block 502) establishing a first electric current through (1) electrolytic solution 222, comprising a quantity of an electrically charged material, (2) initial electrode 160, a surface of at least a portion of which is in direct physical contact with electrolytic solution 222, and (3) transitional electrode 162, a surface of at least a portion of which is in direct physical contact with electrolytic solution 222, so that a quantity of the electrically charged material in electrolytic solution 222 is converted to a quantity of an electrically neutral material, which is electroplated, as deposit 166, onto the surface of at least the portion of transitional electrode 162. Method 500 also comprises a step of (block 504) terminating the first electric current through electrolytic solution 222, initial electrode 160, and transitional electrode 162. Method 500 further comprises a step of (block 506) eliminating the direct physical contact of transitional electrode 162 with electrolytic solution 222 and (block 508) establishing direct physical contact of a surface of at least a portion of transitional electrode 162 with second electrolytic solution 226, comprising at least one of a quantity of the electrically charged material or a quantity of a second electrically charged material. Method 500 additionally comprises a step of (block 510) establishing a second electric current through second electrolytic solution 226, transitional electrode 162, and target electrode 164, a surface of at least the portion of which is in direct physical contact with second electrolytic solution 226, so that a quantity of the electrically neutral material from deposit 166, formed on the surface of at least the portion of transitional electrode 162, is converted to a quantity of the electrically charged material, which is dissolved into second electrolytic solution 226, and either a quantity of the electrically charged material in second electrolytic solution 226 is converted to a quantity of the electrically neutral material, which is electroplated onto the surface of at least the portion of target electrode 164, or a quantity of the second electrically charged material in second electrolytic solution 226 is converted to a quantity of a second electrically neutral material, which is electroplated onto the surface of at least the portion of target electrode 164.

Method 500 promotes a reduction in bubbles, generated in electrolytic solution 222 when the electrically neutral material or the second electrically neutral material is electroplated onto the surface of at least the portion of target electrode 164. Converting the electrically neutral material from deposit 166 to the quantity of electrically charged material in second electrolytic solution 226 enables an electric current, sufficient to deposit the electrically neutral material or the second electrically neutral material onto target electrode 164, to flow through second electrolytic solution 226 to target electrode 164 while generating little to no bubbles in second electrolytic solution 226. Moreover, converting the quantity of the electrically charged material in electrolytic solution 222 to the quantity of the electrically neutral material and then electroplating, as deposit 166, the quantity of the electrically neutral material onto the surface of at least the portion of transitional electrode 162, provides an efficient and reliable way to replenish the quantity of the electrically neutral material deposited on transitional electrode 162. The use of electrolytic solution 222, to promote electroplating the electrically neutral material onto transitional electrode 162, and the use of second electrolytic solution 226, to promote electroplating the electrically neutral material or the second electrically neutral material onto target electrode 164 helps optimize the two electroplating processes by selecting electrolytic solutions that best facilitate the corresponding electroplating process. Additionally, the use of electrolytic solution 222, to promote electroplating the electrically neutral material onto transitional electrode 162, and the use of second electrolytic solution 226, to promote electroplating the electrically neutral material or the second electrically neutral material onto target electrode 164 helps eliminate skip-plating of the electrically neutral material onto target electrode 164 when the electrically neutral material is being electroplated, as deposit 166, onto the surface of at least the portion of transitional electrode 162.

In one or more examples, at least one of initial electrode 160, transitional electrode 162, and target electrode 164 can be made of copper, or metals that are more electrochemically reactive than copper, such as aluminum, lead, nickel, tin, or zinc or can comprise copper, or metals that are more electrochemically reactive than copper, such as aluminum, lead, nickel, tin, or zinc.

Referring generally to FIG. 4 and particularly to FIGS. 1D-2C for illustrative purposes only and not by way of limitation, the following portion of this paragraph delineates example one hundred four of the subject-matter, disclosed herein. According to example one hundred four, which encompasses example one hundred three, above, electrolytic solution 222 is identical to second electrolytic solution 226.

Electrolytic solution 222, being identical to second electrolytic solution 226, promotes simplicity of executing the steps of method 500 and longevity of the components used to execute method 500.

Referring generally to FIG. 4 and particularly to FIGS. 1D-2C for illustrative purposes only and not by way of limitation, the following portion of this paragraph delineates example one hundred five of the subject-matter, disclosed herein. According to example one hundred five, which encompasses example one hundred three, above, concentrations of electrolytic solution 222 and second electrolytic solution 226 are different.

Concentrations of electrolytic solution 222 and second electrolytic solution 226, being different, provides an electrolytic solution with a concentration that best promotes conversion of the electrically charged material to a quantity of the electrically neutral material and electroplating of the electrically neutral material onto transitional electrode 162, and the electrolytic solution with a different concentration that best promotes conversion of the electrically charged material or the second electrically charged material to the electrically neutral material or the second electrically neutral material, and electroplating of the electrically neutral material or the second electrically neutral material onto target electrode 164.

Referring generally to FIG. 4 and particularly to FIGS. 1D-2C for illustrative purposes only and not by way of limitation, the following portion of this paragraph delineates example one hundred six of the subject-matter, disclosed herein. According to example one hundred six, which encompasses example one hundred three, above, compositions of electrolytic solution 222 and second electrolytic solution 226 are different.

Compositions of electrolytic solution 222 and second electrolytic solution 226, being different, provides an electrolytic solution with a composition that best promotes conversion of the electrically charged material to a quantity of the electrically neutral material and electroplating of the electrically neutral material onto transitional electrode 162, and an electrolytic solution with a different composition that best promotes conversion of the electrically charged material or the second electrically charged material to the electrically neutral material or the second electrically neutral material, and electroplating of the electrically neutral material or the second electrically neutral material onto target electrode 164.

Referring generally to FIG. 4 and particularly to FIGS. 1E-2C for illustrative purposes only and not by way of limitation, the following portion of this paragraph delineates example one hundred seven of the subject-matter, disclosed herein. According to example one hundred seven, which encompasses any one of examples one hundred three to one hundred six, above, the step of establishing direct physical contact between second electrolytic solution 226 and the surface of at least the portion of transitional electrode 162 comprises establishing direct physical contact between second electrolytic solution 226 and at least a portion of a surface of deposit 166, electroplated onto the surface of at least the portion of transitional electrode 162.

Establishing direct physical contact between second electrolytic solution 226 and at least a portion of a surface of deposit 166 on transitional electrode 162 enables the quantity of the electrically neutral material from deposit 166 to be converted to the quantity of the electrically charged material, which is dissolved into second electrolytic solution 226.

Referring generally to FIG. 4 and particularly to FIGS. 1E-2C for illustrative purposes only and not by way of limitation, the following portion of this paragraph delineates example one hundred eight of the subject-matter, disclosed herein. According to example one hundred eight, which encompasses any one of examples one hundred three to one hundred six, above, the step of establishing direct physical contact between second electrolytic solution 226 and the surface of at least the portion of transitional electrode 162 comprises establishing direct physical contact between second electrolytic solution 226 and a surface, comprising at least a portion of a surface of deposit 166, electroplated onto the surface of at least the portion of transitional electrode 162, and establishing direct physical contact between second electrolytic solution 226 and at least a portion of a surface of transitional electrode 162, not covered by deposit 166.

Second electrolytic solution 226 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into second electrolytic solution 226.

Referring generally to FIG. 4 and particularly to FIGS. 1D-2C for illustrative purposes only and not by way of limitation, the following portion of this paragraph delineates example one hundred nine of the subject-matter, disclosed herein. According to example one hundred nine, which encompasses any one of examples one hundred three to one hundred eight, above, a rate of electroplating the quantity of the electrically neutral material in electrolytic solution 222 onto the surface of at least the portion of transitional electrode 162 is higher than a rate electroplating the quantity of the electrically neutral material or the quantity of the second electrically neutral material in second electrolytic solution 226 onto the surface of at least the portion of target electrode 164.

The rate of electroplating the quantity of the electrically neutral material onto the surface of at least the portion of transitional electrode 162, being higher than the rate of electroplating the quantity of the electrically neutral material or the quantity of the second electrically neutral material onto the surface of at least the portion of target electrode 164, helps to quickly replenish deposit 166 with electrically neutral material in advance of the quantity of the electrically neutral material or the second electrically neutral material being electroplated onto the surface of at least the portion of target electrode 164. In some examples, because the quality of deposit 166 can be lower than the quality of the electrically neutral material or second electrically neutral material electroplated onto the surface of at least the portion of target electrode 164, the rate of electroplating the quantity of the electrically neutral material onto the surface of at least the portion of transitional electrode 162 can be higher than the rate of electroplating the quantity of the electrically neutral material or the second electrically neutral material onto the surface of at least the portion of target electrode 164.

Figure 1D:
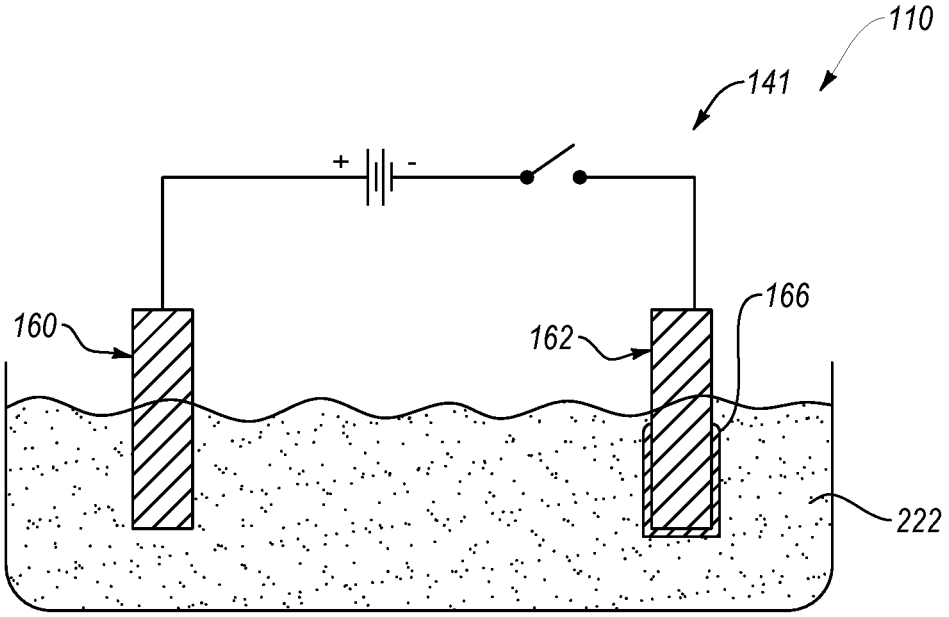
FIG. 1D is a schematic, side elevation, sectional view of an initial electrode, a transitional electrode, and an electric-power supply circuit of the electrochemical-deposition apparatus of FIG. 1A, according to one or more examples of the subject matter, disclosed herein.
Figure 1E:
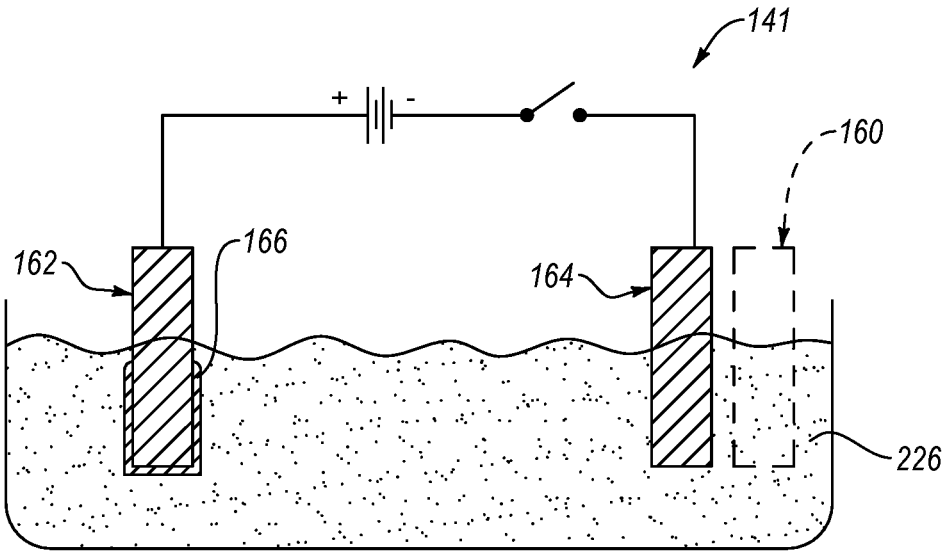
FIG. 1E is a schematic, side elevation, sectional view of a transitional electrode, a target electrode, and an electric-power supply circuit of the electrochemical-deposition apparatus of FIG. 1A, according to one or more examples of the subject matter, disclosed herein.

Referring generally to FIG. 4 and particularly to FIGS. 1E and 2A for illustrative purposes only and not by way of limitation, the following portion of this paragraph delineates example one hundred ten of the subject-matter, disclosed herein. According to example one hundred ten, which encompasses any one of examples one hundred three to one hundred nine, above, target electrode 164 is interposed between initial electrode 160 and transitional electrode 162.

Target electrode 164, being interposed between initial electrode 160 and transitional electrode 162, enables initial electrode 160, transitional electrode 162, and target electrode 164 to form respective parts of a printhead.

Referring generally to FIG. 4 and particularly to FIGS. 1D-2C for illustrative purposes only and not by way of limitation, the following portion of this paragraph delineates example one hundred eleven of the subject-matter, disclosed herein. According to example one hundred eleven, which encompasses any one of examples one hundred three to one hundred ten, above, the first electric current, passing through electrolytic solution 222, initial electrode 160, and transitional electrode 162, is established by an electric potential difference between initial electrode 160 and transitional electrode 162. The second electric current, passing through second electrolytic solution 226, transitional electrode 162, and target electrode 164, is established by an electric potential difference between target electrode 164 and transitional electrode 162. The electric potential difference between initial electrode 160 and transitional electrode 162 is greater than the electric potential difference between target electrode 164 and transitional electrode 162.

The electric potential difference between initial electrode 160 and transitional electrode 162, being greater than the electric potential difference between target electrode 164 and transitional electrode 162, helps ensure that electrode material of transitional electrode 162 is not dissolved into second electrolytic solution 226 when the electrically neutral material from deposit 166 is converted to a quantity of the electrically charged material, which is dissolved into second electrolytic solution 226.

Referring generally to FIG. 4 and particularly to FIGS. 1D-2C for illustrative purposes only and not by way of limitation, the following portion of this paragraph delineates example one hundred twelve of the subject-matter, disclosed herein. According to example one hundred twelve, which encompasses example one hundred eleven, above, the electric potential difference between initial electrode 160 and transitional electrode 162 is above 2V and the electric potential difference between target electrode 164 and transitional electrode 162 is below 1V.

The electric potential difference between initial electrode 160 and transitional electrode 162, being above 2V, and the electric potential difference between target electrode 164 and transitional electrode 162, being below 1V helps ensure that electrode material of transitional electrode 162 is not dissolved into second electrolytic solution 226 when the electrically neutral material from deposit 166 is converted to the quantity of the electrically charged material, which is dissolved into second electrolytic solution 226.

Referring generally to FIG. 4 and particularly to FIGS. 1D-2C for illustrative purposes only and not by way of limitation, the following portion of this paragraph delineates example one hundred thirteen of the subject-matter, disclosed herein. According to example one hundred thirteen, which encompasses any one of examples one hundred three to one hundred twelve, above, initial electrode 160 comprises a quantity of an electrode material, and transitional electrode 162 comprises a quantity of the electrode material.

Initial electrode 160 and transitional electrode 162, comprising a quantity of the electrode material, enables initial electrode 160 and transitional electrode 162 to be made of the same material, which promotes simplicity in manufacturing, assembling, and operating an electrochemical-deposition apparatus that executes method 500.

Referring generally to FIG. 4 and particularly to FIGS. 1D-2C for illustrative purposes only and not by way of limitation, the following portion of this paragraph delineates example one hundred fourteen of the subject-matter, disclosed herein. According to example one hundred fourteen, which encompasses example one hundred thirteen, above, target electrode 164 comprises a quantity of the electrode material.

Target electrode 164, being made of a quantity of the electrode material, enables initial electrode 160, transitional electrode 162, and target electrode 164 to be made of the same material, which promotes simplicity in manufacturing, assembling, and operating an electrochemical-deposition apparatus that executes method 500.

Referring generally to FIG. 4 and particularly to FIGS. 1D-2C for illustrative purposes only and not by way of limitation, the following portion of this paragraph delineates example one hundred fifteen of the subject-matter, disclosed herein. According to example one hundred fifteen, which encompasses example one hundred thirteen or one hundred fourteen, above, the electrically neutral material and the electrode material have different chemical compositions.

In one or more examples, the electrically neutral material and the electrode material, having different chemical compositions, enable one material to be deposited on transitional electrode 162, made of another material.

Referring generally to FIG. 4 and particularly to FIGS. 1D-2C for illustrative purposes only and not by way of limitation, the following portion of this paragraph delineates example one hundred sixteen of the subject-matter, disclosed herein. According to example one hundred sixteen, which encompasses any one of examples one hundred thirteen to one hundred fifteen, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into second electrolytic solution 226 without affecting the electrode material.

Referring generally to FIG. 4 and particularly to FIGS. 1D-2C for illustrative purposes only and not by way of limitation, the following portion of this paragraph delineates example one hundred seventeen of the subject-matter, disclosed herein. According to example one hundred seventeen, which encompasses any one of examples one hundred thirteen to one hundred sixteen, above, target electrode 164 comprises a material, identical to that of deposit 166.

Material of target electrode 164, being identical to that of deposit 166, promotes the quality of the deposit of the electrically neutral material or the second electrically neutral material onto target electrode 164.

Referring generally to FIG. 4 and particularly to FIGS. 1D-2C for illustrative purposes only and not by way of limitation, the following portion of this paragraph delineates example one hundred eighteen of the subject-matter, disclosed herein. According to example one hundred eighteen, which encompasses any one of examples one hundred three to one hundred twelve, above, initial electrode 160 consists of a quantity of an electrode material, and transitional electrode 162 consists of a quantity of the electrode material.

Initial electrode 160 and transitional electrode 162, consisting of a quantity of the electrode material, enables initial electrode 160 and transitional electrode 162 to be more easily manufactured, assembled, and operated.

Referring generally to FIG. 4 and particularly to FIGS. 1D-2C for illustrative purposes only and not by way of limitation, the following portion of this paragraph delineates example one hundred nineteen of the subject-matter, disclosed herein. According to example one hundred nineteen, which encompasses example one hundred eighteen, above, target electrode 164 consists of a quantity of the electrode material.

Target electrode 164, consisting of a quantity of the electrode material, enables initial electrode 160, transitional electrode 162, and target electrode 164 to be made of the same material, which promotes simplicity in manufacturing, assembling, and operating an electrochemical-deposition apparatus that executes method 500.

Referring generally to FIG. 4 and particularly to FIGS. 1D-2C for illustrative purposes only and not by way of limitation, the following portion of this paragraph delineates example one hundred twenty of the subject-matter, disclosed herein. According to example one hundred twenty, which encompasses example one hundred eighteen or one hundred nineteen, above, the electrically neutral material and the electrode material have different chemical compositions.

In one or more examples, the electrically neutral material and the electrode material, having different chemical compositions, enable one material to be deposited on transitional electrode 162, made of another material.

Referring generally to FIG. 4 and particularly to FIGS. 1D-2C for illustrative purposes only and not by way of limitation, the following portion of this paragraph delineates example one hundred twenty-one of the subject-matter, disclosed herein. According to example one hundred twenty-one, which encompasses any one of examples one hundred eighteen to one hundred twenty, above, the electrically neutral material is more electrochemically reactive than the electrode material.

The electrically neutral material, being more electrochemically reactive than the electrode material, enables the electrically neutral material to be converted to a quantity of the electrically charged material and to be dissolved into second electrolytic solution 226 without affecting the electrode material.

Referring generally to FIG. 4 and particularly to FIGS. 1D-2C for illustrative purposes only and not by way of limitation, the following portion of this paragraph delineates example one hundred twenty-two of the subject-matter, disclosed herein. According to example one hundred twenty-two, which encompasses any one of examples one hundred eighteen to one hundred twenty-one, above, target electrode 164 comprises a material, identical to that of deposit 166.

Material of target electrode 164, being identical to that of deposit 166, promotes the quality of the deposit of the electrically neutral material or second electrically neutral material onto target electrode 164.

Referring generally to FIG. 4 and particularly to FIGS. 1D and 2C for illustrative purposes only and not by way of limitation, the following portion of this paragraph delineates example one hundred twenty-three of the subject-matter, disclosed herein. According to example one hundred twenty-three, which encompasses any one of examples one hundred three to one hundred twelve, above, initial electrode 160 comprises a quantity of a first electrode material, and transitional electrode 162 comprises a quantity of a second electrode material. The first electrode material is more electrochemically reactive than the second electrode material.

The first electrode material of initial electrode 160, being more electrochemically reactive than the second electrode material of transitional electrode 162, enables first electrode material of initial electrode 160 to be dissolved in second electrolytic solution 226 when the first electric current is directed through second electrolytic solution 226, initial electrode 160, and transitional electrode 162.

Referring generally to FIG. 4 and particularly to FIGS. 1D and 2C for illustrative purposes only and not by way of limitation, the following portion of this paragraph delineates example one hundred twenty-four of the subject-matter, disclosed herein. According to example one hundred twenty-four, which encompasses any one of examples one hundred three to one hundred twelve, above, initial electrode 160 consists of a quantity of a first electrode material, and transitional electrode 162 consists of a quantity of a second electrode material. The first electrode material is more electrochemically reactive than the second electrode material.

The first electrode material of initial electrode 160, being more electrochemically reactive than the second electrode material of transitional electrode 162, enables first electrode material of initial electrode 160 to be dissolved in second electrolytic solution 226 when the first electric current is directed through second electrolytic solution 226, initial electrode 160, and transitional electrode 162.

Referring generally to FIG. 4 and particularly to FIGS. 2B and 2C for illustrative purposes only and not by way of limitation, the following portion of this paragraph delineates example one hundred twenty-five of the subject-matter, disclosed herein. According to example one hundred twenty-five, which encompasses any one of examples one hundred three to one hundred twenty-four, above, maximum distance d3 between the transitional electrode 162 and target electrode 164 is less than 5 millimeters.

In one or more examples, shortest maximum distance d3, being less than 5 millimeters, promotes electroplating of the quantity of the electrically neutral material or the second electrically neutral material onto the surface of target electrode 164 in an efficient and precise manner in view of the specific dimensions of the components of the electroplating cell, in which material deposition is taking place.

Referring generally to FIG. 4 and particularly to FIGS. 2A-2C for illustrative purposes only and not by way of limitation, the following portion of this paragraph delineates example one hundred twenty-six of the subject-matter, disclosed herein. According to example one hundred twenty-six, which encompasses any one of examples one hundred three to one hundred twenty-five, above, maximum distance d1 between initial electrode 160 and transitional electrode 162 is less than 5 millimeters.

In one or more examples, shortest maximum distance d1, being less than 5 millimeters, promotes electroplating of the quantity of the electrically neutral material, as deposit 166, onto transitional electrode 162 in an efficient manner in view of the specific dimensions of the components of the electroplating cell, in which material deposition is taking place.

Referring generally to FIG. 4 and particularly to FIGS. 1D-2C for illustrative purposes only and not by way of limitation, the following portion of this paragraph delineates example one hundred twenty-seven of the subject-matter, disclosed herein. According to example one hundred twenty-seven, which encompasses any one of examples one hundred three to one hundred twenty-six, above, the first electric current through electrolytic solution 222, initial electrode 160, and transitional electrode 162 is terminated when deposit 166 reaches a predetermined size.

Terminating the first electric current, when deposit 166 reaches a predetermined size, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 4 and particularly to FIGS. 1D-2C for illustrative purposes only and not by way of limitation, the following portion of this paragraph delineates example one hundred twenty-eight of the subject-matter, disclosed herein. According to example one hundred twenty-eight, which encompasses any one of examples one hundred three to one hundred twenty-six, above, the first electric current through electrolytic solution 222, initial electrode 160, and transitional electrode 162 is terminated after a predetermined period of time has elapsed.

Terminating the first electric current, after the predetermined period of time has elapsed, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 4 and particularly to FIGS. 1A-1C and 2A-2C for illustrative purposes only and not by way of limitation, the following portion of this paragraph delineates example one hundred twenty-nine of the subject-matter, disclosed herein. According to example one hundred twenty-nine, which encompasses any one of examples one hundred three to one hundred twenty-six, above, the first electric current, passing through electrolytic solution 222, initial electrode 160, and transitional electrode 162, is terminated when a spatial distribution of deposit 166 reaches a predetermined spatial-distribution threshold.

Terminating the first electric current, when the spatial distribution of deposit 166 reaches a predetermined spatial-distribution threshold, helps ensure deposit 166 is large enough and is properly spatially distributed to effectively promote electroplating of electrically neutral material onto target electrode 164.

Referring generally to FIG. 4 and particularly to FIGS. 1A-1C and 2A-2C for illustrative purposes only and not by way of limitation, the following portion of this paragraph delineates example one hundred thirty of the subject-matter, disclosed herein. According to example one hundred thirty, which encompasses any one of examples one hundred three to one hundred twenty-six, above, the first electric current, passing through electrolytic solution 222, initial electrode 160, and transitional electrode 162, is terminated when the first electric current reaches a predetermined electric-current threshold.

Terminating the first electric current, when the first electric current reaches a predetermined electric-current threshold, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 4 and particularly to FIGS. 1A-1C and 2A-2C for illustrative purposes only and not by way of limitation, the following portion of this paragraph delineates example one hundred thirty-one of the subject-matter, disclosed herein. According to example one hundred thirty-one, which encompasses any one of examples one hundred three to one hundred twenty-six, above, the first electric current, passing through electrolytic solution 222, initial electrode 160, and transitional electrode 162, is established by an electric potential difference between initial electrode 160 and transitional electrode 162. The first electric current, passing through electrolytic solution 222, initial electrode 160, and transitional electrode 162, is terminated when the electric potential difference reaches a predetermined electric-potential-difference threshold.

Terminating the first electric current, when the electric potential difference reaches a predetermined electric-potential-difference threshold, helps to ensure deposit 166 is large enough to effectively promote electroplating of electrically neutral material onto target electrode 164, and to prevent deposit 166 from reaching a size, large enough to cause shorts between transitional electrode 162 and target electrode 164 and/or between transitional electrode 162 and initial electrode 160.

Referring generally to FIG. 4 and particularly to FIGS. 1D, 1E, and 2A-2C for illustrative purposes only and not by way of limitation, the following portion of this paragraph delineates example one hundred thirty-two of the subject-matter, disclosed herein. According to example one hundred thirty-two, which encompasses any one of examples one hundred three to one hundred thirty-one, above, the step of establishing the second electric current through second electrolytic solution 226, transitional electrode 162, and target electrode 164 is performed when second electrolytic solution 226 is in direct physical contact with a surface of at least a portion of transitional electrode 162, which has a greater area than the surface of at least the portion of transitional electrode 162, onto which the electrically neutral material is electroplated as deposit 166.

Second electrolytic solution 226 being in direct physical contact with a surface of at least a portion of transitional electrode 162, which has a greater area than the surface of at least the portion of transitional electrode 162, onto which the electrically neutral material is electroplated as deposit 166, enables variability in the degree of submersion of transitional electrode 162 into second electrolytic solution 226.

Different examples of the apparatus(es) and method(s) disclosed herein include a variety of components, features, and functionalities. It should be understood that the various examples of the apparatus(es) and method(s), disclosed herein, can include any of the components, features, and functionalities of any of the other examples of the apparatus(es) and method(s) disclosed herein in any combination.

Many modifications of examples, set forth herein, will become apparent to those skilled in the art, having the benefit of the teachings, presented in the foregoing descriptions and the associated drawings.

Therefore, it is to be understood that the subject matter, disclosed herein, is not to be limited to the specific examples illustrated and that modifications and other examples are intended to be included within the scope of the appended claims. Moreover, although the foregoing description and the associated drawings describe examples of the subject matter, disclosed herein, in the context of certain illustrative combinations of elements and/or functions, it should be appreciated that different combinations of elements and/or functions may be provided by alternative implementations without departing from the scope of the appended claims. Accordingly, parenthetical reference numerals, if any, in the appended claims are presented for illustrative purposes only and are not intended to limit the scope of the claimed subject matter to the specific examples, provided herein.

What is claimed is:

1. An electrochemical-deposition apparatus for forming a part, comprising:

an initial electrode;

a transitional electrode, wherein the initial electrode and the transitional electrode are coplanar and a first plane passes through the initial electrode and the transitional electrode;

a target electrode, wherein a second plane passes through the target electrode and does not pass through the initial electrode nor the transitional electrode, the second plane being offset from and parallel to the first plane, and wherein the initial electrode and the transitional electrode are individually addressable and form part of an electrode array of a printhead;

an electric-power supply circuit, electrically couplable with the initial electrode, the transitional electrode, and the target electrode; and a controller, configured to, sequentially:

direct the electric-power supply circuit to establish a first electric current through an electrolytic solution, the initial electrode, and the transitional electrode when a surface of at least a portion of the initial electrode is in direct physical contact with the electrolytic solution, and a surface of at least a portion of the transitional electrode is in direct physical contact with the electrolytic solution, so that a quantity of an electrically charged material in the electrolytic solution is converted to a quantity of an electrically neutral material, which is electroplated, as a deposit, onto the surface of at least the portion of the transitional electrode, direct the electric-power supply circuit to terminate the first electric current through the electrolytic solution, the initial electrode, and the transitional electrode, and direct the electric-power supply circuit to either:

establish a second electric current through the electrolytic solution, the transitional electrode, and the target electrode when a surface of at least a portion of the deposit is in direct physical contact with the electrolytic solution, and a surface of at least a portion of the target electrode is in direct physical contact with the electrolytic solution, so that:

a quantity of the electrically neutral material from the deposit is converted to a quantity of the electrically charged material, which is dissolved into the electrolytic solution, and a quantity of the electrically charged material in the electrolytic solution is converted to a quantity of the electrically neutral material, which is electroplated onto the surface of at least the portion of the target electrode, wherein the quantity of the electrically neutral material electroplated onto the surface of at least the portion of the target electrode forms at least a portion of the part, or establish a third electric current through a second electrolytic solution, the transitional electrode, and the target electrode when a surface of at least a portion of the deposit is in direct physical contact with the second electrolytic solution, and a surface of at least a portion of the target electrode is in direct physical contact with the second electrolytic solution, so that:

a quantity of the electrically neutral material from the deposit is converted to a quantity of the electrically charged material, which is dissolved into the second electrolytic solution, and one of:

a quantity of the electrically charged material in the second electrolytic solution is converted to a quantity of the electrically neutral material, which is electroplated onto the surface of at least the portion of the target electrode, or a quantity of a second electrically charged material in the second electrolytic solution is converted to a quantity of a second electrically neutral material, which is electroplated onto the surface of at least the portion of the target electrode wherein the quantity of the second electrically neutral material electroplated onto the surface of at least the portion of the target electrode forms at least a portion of the part.

2. The electrochemical-deposition apparatus according to claim 1, wherein the controller is configured to direct the electric-power supply circuit to establish the first electric current through the electrolytic solution, the initial electrode, and the transitional electrode and also to direct the electric-power supply circuit to either establish the second electric current through the electrolytic solution, the transitional electrode, and the target electrode, or to establish the third electric current through the second electrolytic solution, the transitional electrode, and the target electrode, such that a rate of electroplating the quantity of the electrically neutral material onto the surface of at least the portion of the transitional electrode is higher than a rate of electroplating the quantity of the electrically neutral material onto the surface of at least the portion of the target electrode.

3. The electrochemical-deposition apparatus according to claim 1, wherein:

the first electric current, passing through the electrolytic solution, the initial electrode, and the transitional electrode, is established by an electric potential difference between the initial electrode and the transitional electrode;

the second electric current, passing through the electrolytic solution, the transitional electrode, and the target electrode, is established by an electric potential difference between the target electrode and the transitional electrode; and the electric potential difference between the initial electrode and the transitional electrode is greater than the electric potential difference between the target electrode and the transitional electrode.

4. The electrochemical-deposition apparatus according to claim 3, wherein the electric potential difference between the initial electrode and the transitional electrode is above 2V, and the electric potential difference between the target electrode and the transitional electrode is below 1V.

5. The electrochemical-deposition apparatus according to claim 1, wherein: the first electric current, passing through the electrolytic solution, the initial electrode, and the transitional electrode, is established by an electric potential difference between the initial electrode and the transitional electrode;

the third electric current, passing through the second electrolytic solution, the transitional electrode, and the target electrode, is established by an electric potential difference between the target electrode and the transitional electrode; and the electric potential difference between the initial electrode and the transitional electrode is greater than the electric potential difference between the target electrode and the transitional electrode.

6. The electrochemical-deposition apparatus according to claim 5, wherein the electric potential difference between the initial electrode and the transitional electrode is above 2V, and the electric potential difference between the target electrode and the transitional electrode is below 1V.

7. The electrochemical-deposition apparatus according to claim 1, wherein:

the initial electrode comprises a quantity of an electrode material; and the transitional electrode comprises a quantity of the electrode material.

8. The electrochemical-deposition apparatus according to claim 7, wherein the target electrode comprises a quantity of the electrode material.

9. The electrochemical-deposition apparatus according to claim 7, wherein the electrically neutral material and the electrode material have different chemical compositions.

10. The electrochemical-deposition apparatus according to claim 7, wherein the electrically neutral material is more electrochemically reactive than the electrode material.

11. The electrochemical-deposition apparatus according to claim 1, wherein:

the initial electrode consists of a quantity of an electrode material; and the transitional electrode consists of a quantity of the electrode material.

12. The electrochemical-deposition apparatus according to claim 11, wherein the target electrode consists of a quantity of the electrode material.

13. The electrochemical-deposition apparatus according to claim 11, wherein the electrically neutral material and the electrode material have different chemical compositions.

14. The electrochemical-deposition apparatus according to claim 11, wherein the electrically neutral material is more electrochemically reactive than the electrode material.

15. The electrochemical-deposition apparatus according to claim 1, wherein:

the transitional electrode comprises a quantity of an electrode material;

the initial electrode comprises a quantity of a second electrode material; and the second electrode material is more electrochemically reactive than the electrode material.

16. The electrochemical-deposition apparatus according to claim 1, wherein:

the transitional electrode consists of a quantity of an electrode material;

the initial electrode consists of a quantity of a second electrode material; and the second electrode material is more electrochemically reactive than the electrode material.

17. The electrochemical-deposition apparatus according to claim 1, further comprising electrodes, couplable with the electric-power supply circuit, wherein:

the electrodes, the initial electrode, the transitional electrode, and the target electrode are individually addressable and form an electrode array of a printhead; and the electrodes, the initial electrode, the transitional electrode, and the target electrode are made of an electrode material.

18. The electrochemical-deposition apparatus according to claim 1, wherein the initial electrode and the transitional electrode have different surface areas.

19. The electrochemical-deposition apparatus according to claim 1, wherein a maximum distance between the initial electrode and the transitional electrode is less than 15 centimeters.

* * * * *